US011855402B2

(12) United States Patent
Hamada et al.

(10) Patent No.: US 11,855,402 B2
(45) Date of Patent: Dec. 26, 2023

(54) CONNECTOR STRUCTURE AND CONNECTOR STRUCTURE MANUFACTURING METHOD

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Kazuaki Hamada, Mie (JP); Junichi Ono, Mie (JP); Atsushi Murata, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 268 days.

(21) Appl. No.: 17/312,864

(22) PCT Filed: Dec. 3, 2019

(86) PCT No.: PCT/JP2019/047257
§ 371 (c)(1),
(2) Date: Jun. 10, 2021

(87) PCT Pub. No.: WO2020/129624
PCT Pub. Date: Jun. 25, 2020

(65) Prior Publication Data

US 2022/0013971 A1 Jan. 13, 2022

(30) Foreign Application Priority Data

Dec. 21, 2018 (JP) ..... 2018-239931

(51) Int. Cl.
*H01R 43/048* (2006.01)
*H01R 24/40* (2011.01)
*H01R 103/00* (2006.01)

(52) U.S. Cl.
CPC ..... *H01R 43/048* (2013.01); *H01R 24/40* (2013.01); *H01R 2103/00* (2013.01)

(58) Field of Classification Search
CPC ... H01R 43/048; H01R 24/40; H01R 2103/00
(Continued)

(56) References Cited

U.S. PATENT DOCUMENTS 6,709,290 B2 * 3/2004 Yoshida ..... H01R 24/44 439/585
6,809,265 B1 * 10/2004 Gladd ..... H01R 9/0524 174/84 C
(Continued)

FOREIGN PATENT DOCUMENTS

DE 10315042 A1 * 10/2003 ..... H01R 13/4361
JP 2002042987 A * 2/2002
(Continued)

OTHER PUBLICATIONS

International Search Report dated Feb. 15, 2020 for WO 2020/129624 A1 (4 pages).

*Primary Examiner* — Peter G Leigh
(74) *Attorney, Agent, or Firm* — Venjuris, P.C.

(57) ABSTRACT

A female connector structure is provided with a shielded cable configured such that an outer periphery of a coated wire including a core and an insulation coating is surrounded by a braided wire, a female terminal including a wire barrel and a connecting tube portion continuous with the wire barrel and to be connected to a mating terminal, an insulating dielectric, a front outer conductor including a front tube portion and a dielectric locking portion to be locked to at least a part of the dielectric, and a rear outer conductor 33
(Continued)

including a rear tube portion for surrounding the outer periphery of the coated wire 13 exposed from the braided wire, a shield crimping portion to be crimped to the braided wire from outside and a front outer conductor crimping portion to be crimped to the dielectric locking portion from outside.

6 Claims, 24 Drawing Sheets

(58) Field of Classification Search
USPC ..... 439/578
See application file for complete search history.

(56) References Cited

U.S. PATENT DOCUMENTS 7,140,914 B2 * 11/2006 Kojima ..... H01R 4/185 439/585
7,249,970 B1 7/2007 Wei
8,277,249 B2 * 10/2012 Koga ..... H01R 4/185 439/585
8,998,641 B2 * 4/2015 Kanda ..... H01R 9/0518 439/585
10,109,935 B2 * 10/2018 Kondo ..... H01R 24/54
10,348,044 B2 7/2019 Surer
10,741,977 B2 8/2020 Maesoba et al.
2004/0206542 A1 * 10/2004 Gladd ..... H02G 15/085 174/78
2011/0028034 A1 2/2011 Morikawa

FOREIGN PATENT DOCUMENTS

JP 2002319458 A * 10/2002
JP 2003257560 A * 9/2003
JP 2003297493 A * 10/2003 ..... H01R 13/4361
JP 2003317882 A * 11/2003
JP 2011-009111 A 1/2011
JP 2011065882 A * 3/2011
JP 2014-232585 A 12/2014
JP 2014232585 A * 12/2014
JP 2015053194 A * 3/2015 ..... H01B 13/012
WO WO-2017144071 A1 * 8/2017 ..... H01R 13/052
WO WO-2018003466 A1 * 1/2018 ..... H01R 13/426

* cited by examiner

CONNECTOR STRUCTURE AND CONNECTOR STRUCTURE MANUFACTURING METHOD

CROSS REFERENCE TO RELATED APPLICATIONS

This application is a national phase of PCT application No. PCT/JP2019/047257, filed on 3 Dec. 2019, which claims priority from Japanese patent application No. 2018-239931, filed on 21 Dec. 2018, all of which are incorporated herein by reference.

TECHNICAL FIELD

A technique disclosed in this specification relates to a connector structure formed by connecting a connector to a shielded cable and a connector structure manufacturing method.

BACKGROUND

A connector structure formed by connecting a connector to an end of a coaxial cable is known from International Publication Pamphlet No. WO 2017/144070. This connector structure includes an inner conductor, a dielectric for surrounding the inner conductor, a contact member for surrounding the outer periphery of the dielectric and a connecting member to be connected to a shield portion of a coaxial cable. A front end part of the connecting member is welded to a rear end part of the contact member while being externally fit. In this way, the contact member and the connecting member are electrically connected.

PRIOR ART DOCUMENT

Patent Document

Patent Document 1: International Publication Pamphlet No. WO 2017/144070

SUMMARY OF THE INVENTION

Problems to be Solved

However, according to the above configuration, the contact member and the connecting member are welded with the dielectric accommodated inside the contact member. Thus, troubles such as the deformation of the dielectric may occur due to heat at the time of welding the contact member and the connecting member.

The technique disclosed in this specification was completed on the basis of the above situation and aims to provide a connector structure in which the occurrence of troubles in a dielectric due to heat is suppressed.

Means to Solve the Problem

The technique disclosed in this specification is directed to a connector structure with a shielded cable configured such that an outer periphery of a coated wire including a core extending in a front-rear direction and an insulation coating surrounding an outer periphery of the core is surrounded by a shield portion, an inner conductor including a core connecting portion to be connected to the core and a connecting portion continuous with the core connecting portion and to be connected to a mating terminal, an insulating dielectric for surrounding at least an outer periphery of the connecting portion of the inner conductor, a front outer conductor including a front tube portion for surrounding an outer periphery of the dielectric and a dielectric locking portion to be locked to at least a part of the dielectric, and a rear outer conductor including a rear tube portion for surrounding the outer periphery of the coated wire exposed from the shield portion, a shield crimping portion to be crimped to the shield portion from outside and a front outer conductor crimping portion to be crimped to at least a part of the front outer conductor from outside.

Further, the technique disclosed in this specification is directed to a connector structure manufacturing method with a step of exposing a core by stripping a front end part of an insulation coating of a shielded cable configured such that an outer periphery of a coated wire including the core extending in a front-rear direction and the insulation coating surrounding an outer periphery of the core is surrounded by a shield portion, a step of arranging an inner conductor in an insulating dielectric with a core connecting portion exposed, a step of accommodating the dielectric inside a front outer conductor, a step of connecting the core connecting portion of the inner conductor to the core exposed from the insulation coating, a step of locking a dielectric locking portion of the front outer conductor to a part of the dielectric, a step of crimping a shield crimping portion provided in a rear outer conductor to the shield portion from outside, and a step of crimping a front outer conductor crimping portion provided in the rear outer conductor to at least a part of the dielectric locking portion from outside.

According to the above technique, the front and rear outer conductors are connected by crimping the front outer conductor crimping portion provided in the rear outer conductor to the dielectric locking portion provided in the front outer conductor from outside. Since processing such as welding becomes unnecessary in this way, the rear and front outer conductors can be connected without heating. In this way, the occurrence of troubles in the dielectric due to heat can be suppressed.

The following modes are preferable as embodiments of the technique disclosed in this specification.

The dielectric locking portion has a smaller or larger diameter than the front tube portion in a radial direction of the front tube portion, and the dielectric includes a retaining portion configured to come into contact with an inner wall surface of the dielectric locking portion from front or behind.

According to the above configuration, the dielectric can be retained and held in the front outer conductor.

One of the front and rear outer conductors is provided with a locking projection projecting toward the other and the other is formed with a locking recess to be locked to the locking projection.

According to the above configuration, the relative positional accuracy of the front and rear outer conductors can be improved by locking the locking projection and the locking recess.

The front outer conductor crimping portion is formed with a positioning projection projecting inward with the front outer conductor crimping portion crimped to an outer periphery of the front outer conductor, and the positioning projection is passed through the front outer conductor and fit in a positioning recess formed by depressing the dielectric.

According to the above configuration, the relative positional accuracy of the front outer conductor, the rear outer conductor and the dielectric can be improved.

One of the front outer conductor crimping portion and a part of the front outer conductor crimped by the front outer conductor crimping portion is provided with a connecting protrusion projecting toward the other with the front outer conductor crimping portion crimped to the outer periphery of the front outer conductor.

According to the above configuration, the rear and front outer conductors can be reliably electrically connected by the contact of the connecting protrusion provided on one of the front outer conductor crimping portion and the part of the front outer conductor crimped by the front outer conductor crimping portion with the other. In this way, the electrical connection reliability of the rear and front outer conductors can be improved.

Effect of the Invention

According to the technique disclosed in this specification, the occurrence of troubles in a dielectric due to heat can be suppressed.

DETAILED DESCRIPTION TO EXECUTE THE INVENTION

First Embodiment

Figure 1:
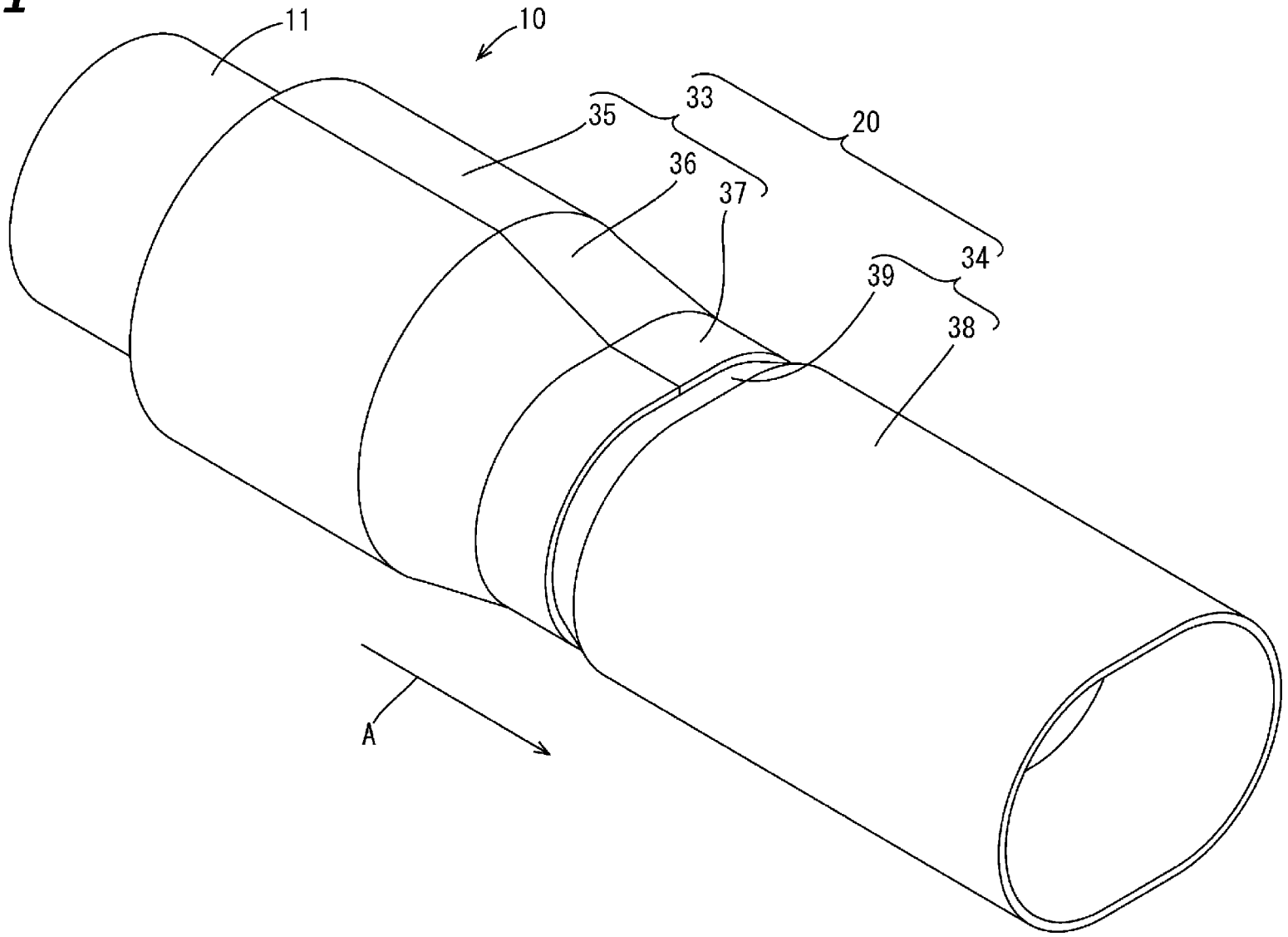
FIG. 1 is a perspective view showing a female connector structure according to a first embodiment.

A first embodiment of the technique disclosed in this specification is described with reference to FIGS. 1 to 10. A female connector structure 10 according to this embodiment is formed by connecting a female connector 12 to an end of a shielded cable 11. The female connector 12 includes female terminals 18 (example of an inner conductor), a dielectric 19, a rear outer conductor 33 and a front outer conductor 34. In the following description, an extending direction (direction indicated by an arrow A) of the shielded cable 11 is referred to as a forward direction. Further, only some of a plurality of identical members may be denoted by a reference sign and the other members may not be denoted by the reference sign.

Shielded Cable 11

Figure 2:
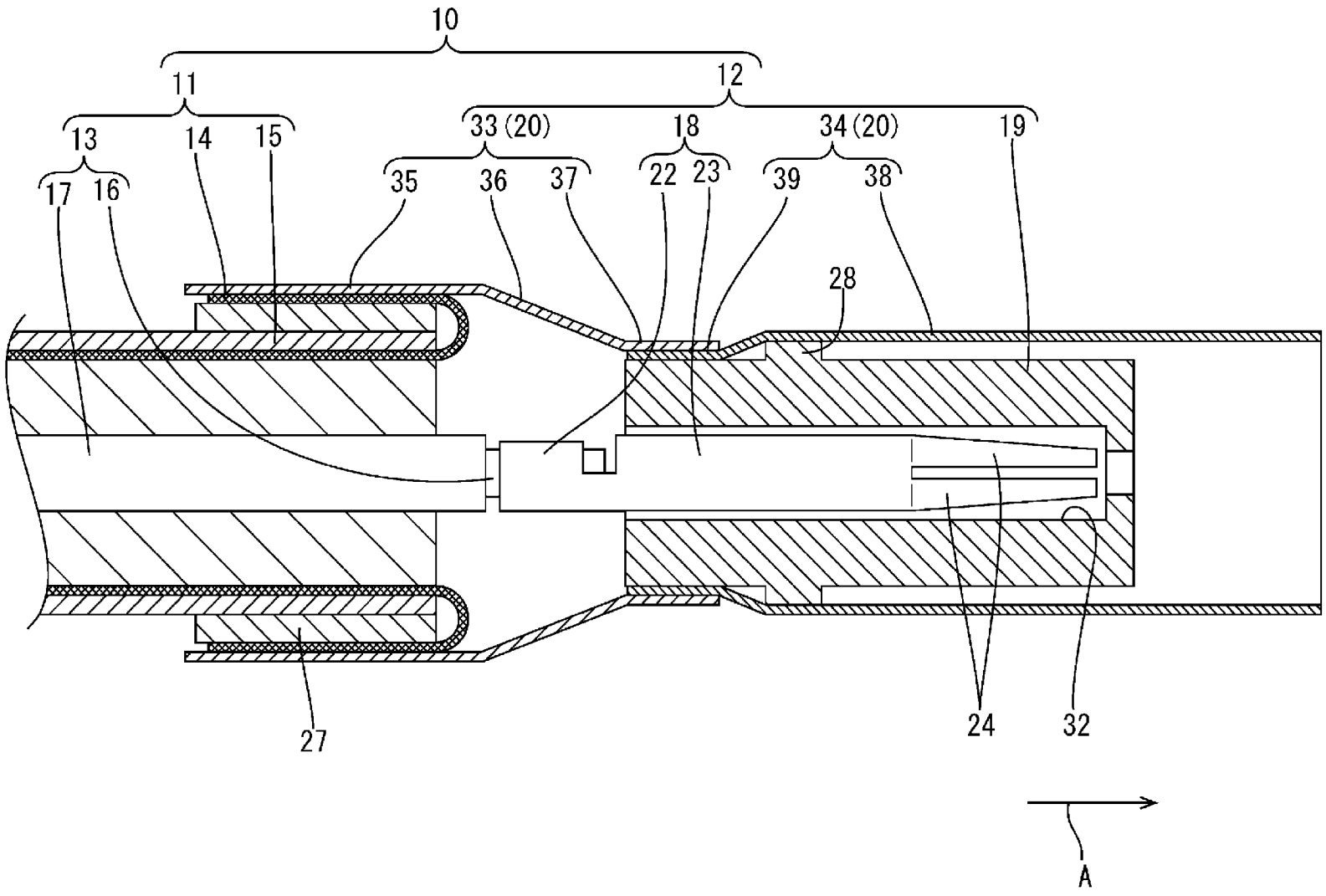
FIG. 2 is a section showing the female connector structure.

As shown in FIG. 2, the shielded cable 11 is configured such that the outer peripheries of a plurality of (two in this embodiment) coated wires 13 are surrounded by a braided wire 14 (example of a shield portion) made of metal thin wires and the outer periphery of the braided wire 14 is surrounded by a sheath 15 made of an insulating material. Each coated wire 13 includes a core 16 and an insulation coating 17 surrounding the outer periphery of the core 16. An arbitrary metal such as copper, copper alloy, aluminum or aluminum alloy can be selected as a metal constituting the core 16 according to need. The core 16 may be formed by one metal strand or may be formed by a stranded wire formed by twisting a plurality of metal strands. The insulation coatings 17 and the sheath 15 are made of insulating synthetic resin.

An end processing such stripping is applied to an end of the shielded cable 11 to expose an end of each of the cores 16, the insulation coatings 17 and the braided wire 14.

Female Connector 12

The female connector 12 includes the female terminals 18 (example of the inner conductor), the insulating dielectric 19 for surrounding the outer peripheries of the female terminals 18 and an outer conductor 20 for surrounding the outer periphery of the dielectric 19. The outer conductor 20 includes the rear outer conductor 33 and the front outer conductor 34 electrically connected to a front end part of the rear outer conductor 33.

Female Terminals 18

Figure 6:
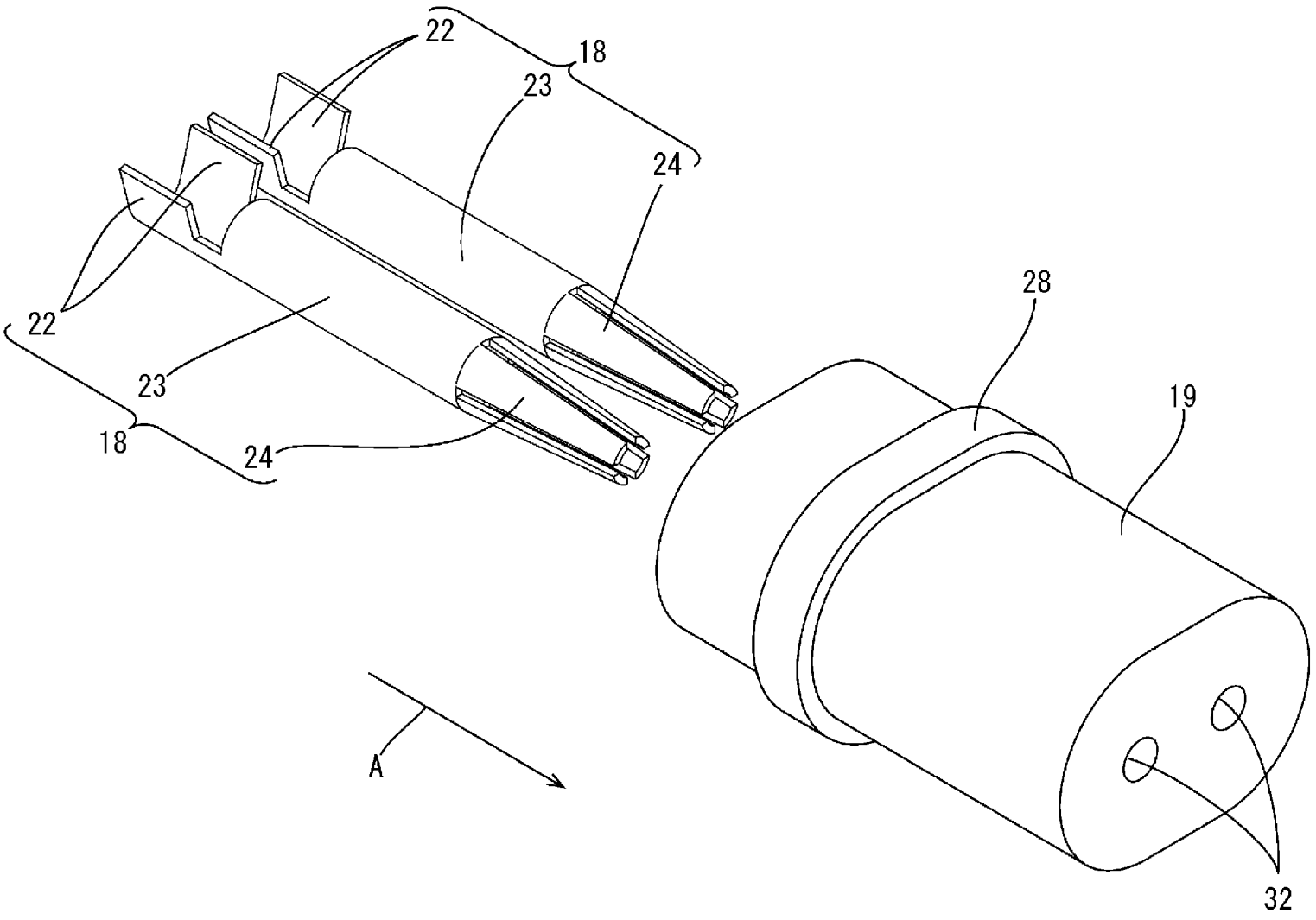
FIG. 6 is a perspective view showing a step of inserting female terminals into a dielectric.

As shown in FIG. 6, the female terminal 18 is formed by press-working a metal plate material into a predetermined shape. An arbitrary metal such as copper, copper alloy, aluminum or aluminum alloy can be selected as a metal constituting the female terminal 18 according to need. The female terminal 18 is connected to the end of each coated wire 13. The female terminal 18 includes a wire barrel 22 (example of a core connecting portion) to be crimped to wind around the outer periphery of the core 16 and a connecting tube portion 23 (example of a connecting portion) connected in front of the wire barrel 22, an unillustrated mating terminal being inserted into the connecting tube portion 23.

The connecting tube portion 23 is formed with a plurality of slits extending rearward from a front end part of the connecting tube portion 23, thereby providing a plurality of resilient contact pieces 24 extending in a front-rear direction. The plurality of resilient contact pieces 24 are reduced in diameter toward a front side and formed to be resiliently deformable in a radial direction of the connecting tube portion 23. By inserting the mating terminal into the connecting tube portion 23, the mating terminal and the resilient contact pieces 24 resiliently contact, whereby the mating terminal and the female terminal 18 are electrically connected.

Braided Wire 14

The braided wire 14 is formed by braiding a plurality of metal thin wires into a tube. A part of the braided wire 14 exposed from the end of the sheath 15 is folded toward an end of the sheath 15 and overlapped on the outside of a sleeve 27 described below.

Sleeve 27

The annular sleeve 27 is externally fit to the outside of the end of the sheath 15. As described above, the braided wire 14 is overlapped on the outside of the sleeve 27. The sleeve 27 according to this embodiment is formed into a substantially annular shape by crimping an elongated metal plate material to wind around the outer periphery of the sheath 15.

Dielectric 19

Figure 7:
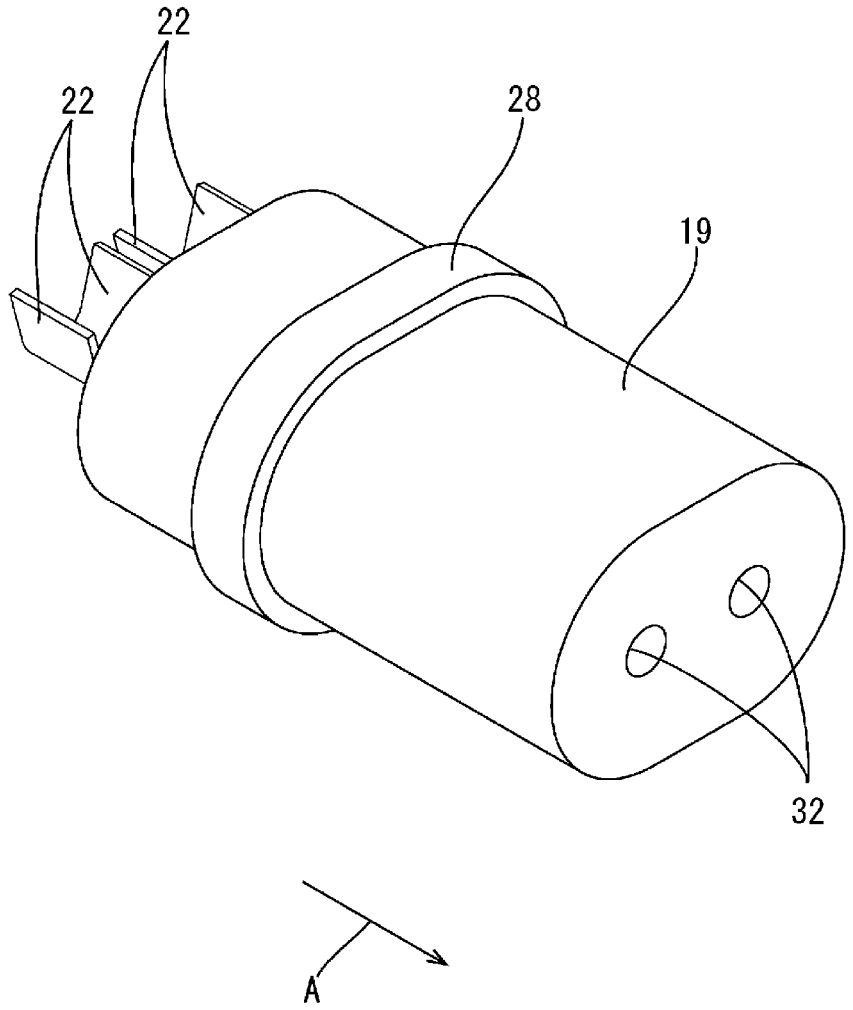
FIG. 7 is a perspective view showing a state where the female terminals are inserted in the dielectric.

As shown in FIG. 2, the connecting tube portion 23 of the female terminal 18 is surrounded around by the dielectric 19. The dielectric 19 is formed by injection molding using an insulating synthetic resin. The wire barrel 22 projects rearward from a rear end part of the dielectric 19. As shown in FIGS. 6 and 7, the dielectric 19 extends in the front-rear direction as a whole and has an oval cross-sectional shape elongated in a lateral direction.

The dielectric 19 is formed with a plurality of (two in this embodiment) cavities 32 which are arranged side by side in the lateral direction and open in the front-rear direction and into which the connecting tube portions 23 of the female terminals 18 are respectively accommodated. The mating terminal is inserted through a front opening of the cavity 32. The wire barrel 22 is drawn out rearward as described above through a rear opening of the cavity 32.

A flange 28 (example of a retaining portion) projecting radially outwardly of the dielectric 19 is formed on substantially one-third part of the dielectric 19 from the rear end part in the front-rear direction.

Front Outer Conductor 34

As shown in FIG. 2, the front outer conductor 34 is formed by press-working a metal plate material into a predetermined shape. An arbitrary metal such as copper, copper alloy, aluminum or aluminum alloy can be selected as a metal constituting the front outer conductor 34 according to need. The front outer conductor 34 includes a front tube portion 38 for surrounding the outer periphery of the dielectric 19 and a dielectric locking portion 39 connected behind the front tube portion 38 and having a smaller diameter than the front tube portion 38. An inner diameter of the front tube portion 38 is set to be equal to or slightly larger than an outer diameter of the flange 28. A front end part of the front tube portion 38 is formed to extend further forward than the front end part of the dielectric 19. The inner wall surface of the dielectric locking portion 39 is locked to the flange 28 of the dielectric 19 and a part of the dielectric 19 behind the flange 28. In this way, the dielectric 19 inserted through a front opening of the front tube portion 38 is held in the front outer conductor 34 while being prevented from coming out rearward.

Rear Outer Conductor 33

Figure 9:
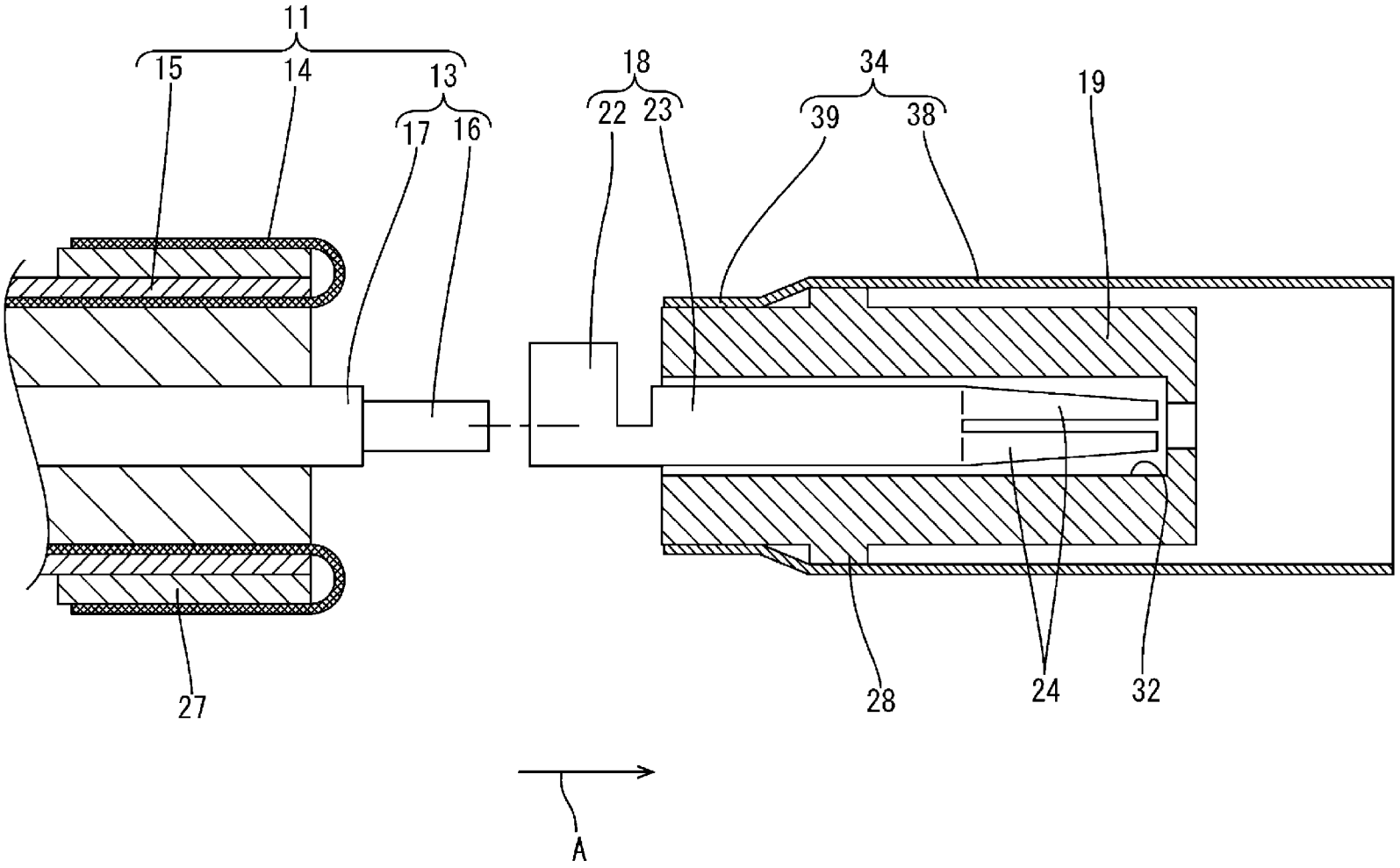
FIG. 9 is a section showing a step of crimping a wire barrel to a core.

As shown in FIGS. 2 and 9, the rear outer conductor 33 is formed by press-working a metal plate material into a predetermined shape. An arbitrary metal such as copper, copper alloy, aluminum or aluminum alloy can be selected as a metal constituting the rear outer conductor 33 according to need. The rear outer conductor 33 includes a shield crimping portion 35 to be crimped to the braided wire 14 folded on the sleeve 27 from outside, a rear tube portion 36 connected in front of the shield crimping portion 35 for surrounding the outer peripheries of the coated wires 13 exposed from the braided wire 14 and a front outer conductor crimping portion 37 connected in front of the rear tube portion 36 and to be crimped to the dielectric locking portion 39 located at a position near the rear end part of the dielectric 19 from outside.

The rear outer conductor 33 is crimped to the outer periphery of the braided wire 14 and crimped to the dielectric locking portion 39 at the position near a rear end part of the dielectric locking portion 39 from outside with both left and right side edges butted against each other. The front outer conductor crimping portion 37 is crimped to a part of the dielectric 19 behind the flange 28. The front outer conductor crimping portion 37 and the dielectric locking portion 39 are fixed to the dielectric 19 and the front and rear outer conductors 34, 33 are electrically connected by crimping the front outer conductor crimping portion 37 to the dielectric locking portion 39 from outside.

An outer diameter of the shield crimping portion 35 is set to be larger than that of the front outer conductor crimping portion 37 with the rear outer conductor 33 crimped to the outer periphery of the braided wire 14 and crimped to the dielectric 19 at the position near the rear end part of the dielectric 19. The rear tube portion 36 located between the shield crimping portion 35 and the front outer conductor crimping portion 37 is formed into a shape reduced in diameter toward the front side.

Manufacturing Process of Female Connector Structure 10

Next, an example of a manufacturing process of the female connector structure 10 according to this embodiment is described. Note that the manufacturing process of the female connector structure 10 is not limited to the following one.

Figure 3:
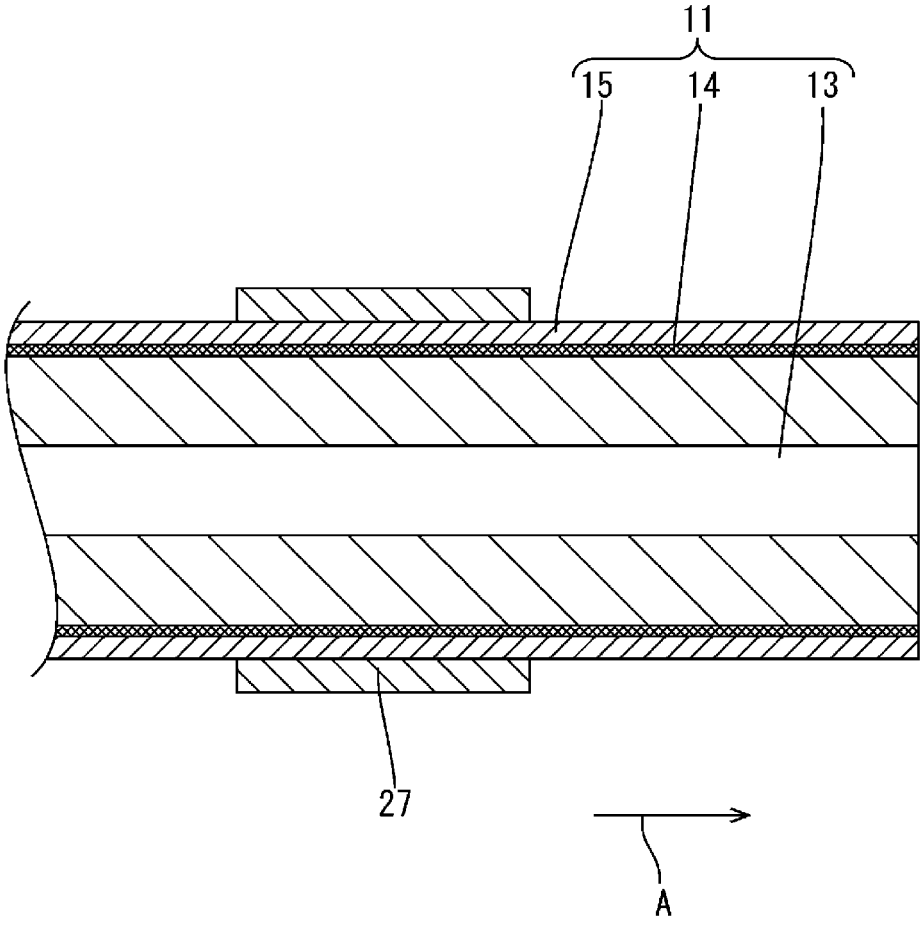
FIG. 3 is a section showing a step of externally fitting a sleeve to a shielded cable.
Figure 4:
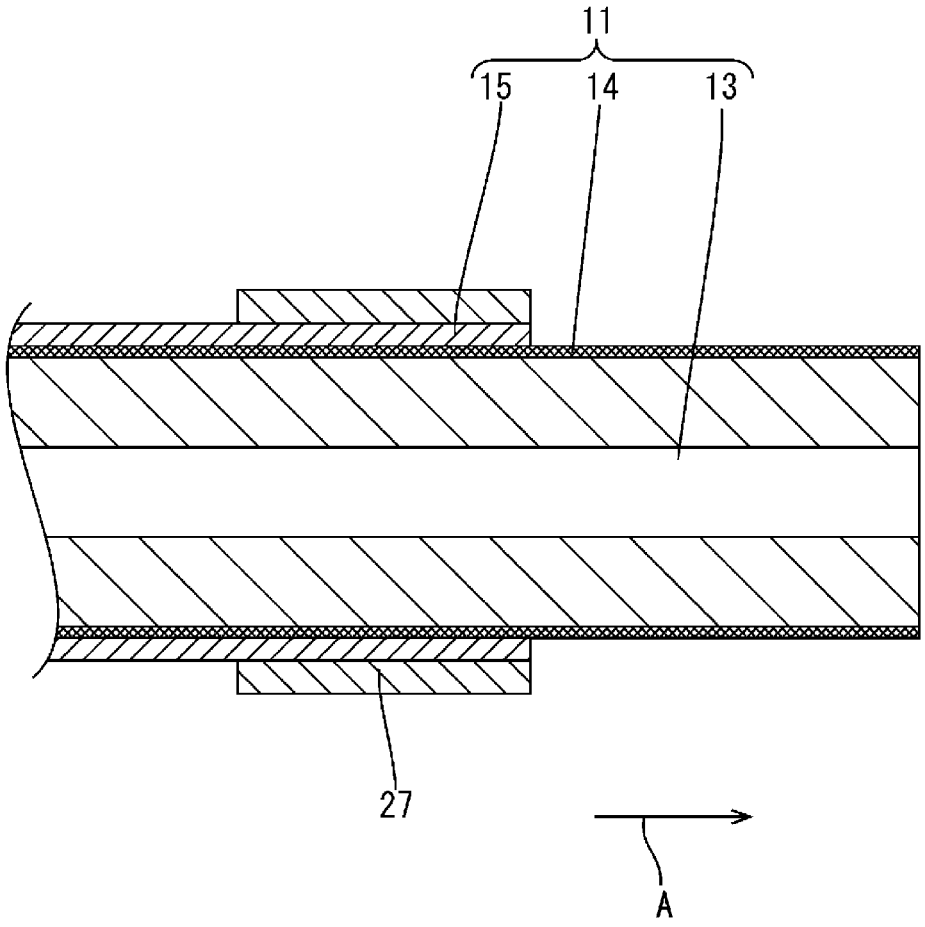
FIG. 4 is a section showing a step of stripping a sheath of the shielded cable.
Figure 5:
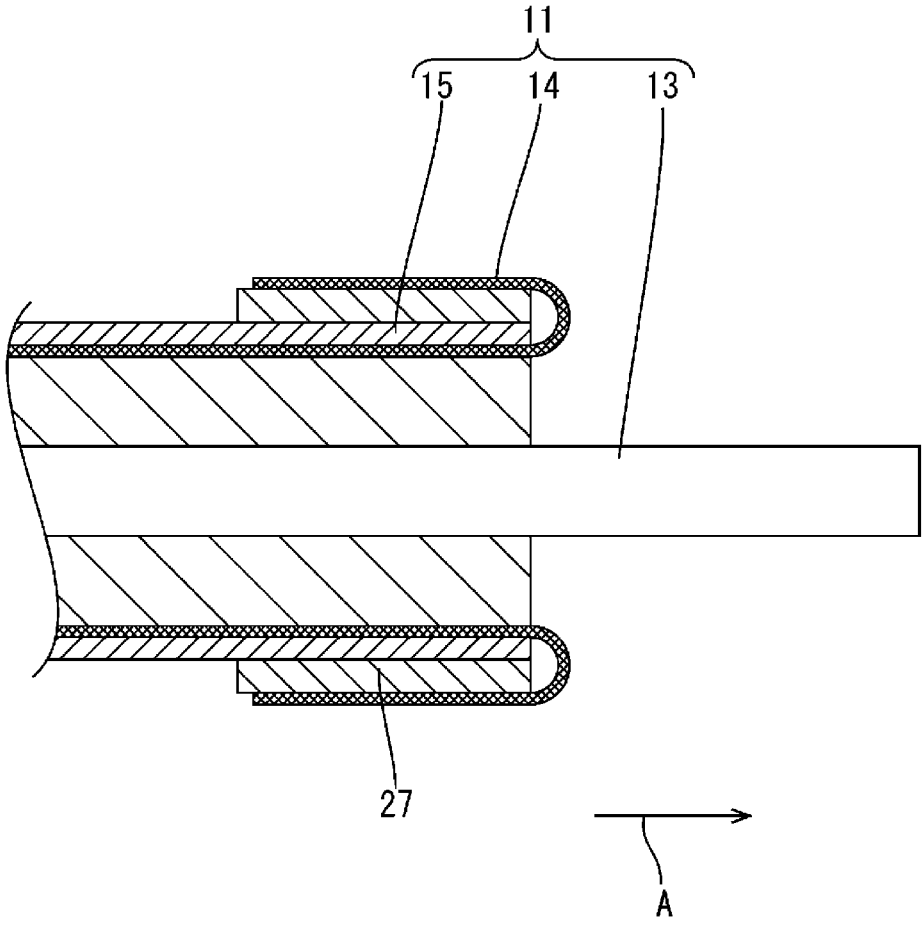
FIG. 5 is a section showing a step of folding a braided wire on the sleeve.

As shown in FIG. 3, the sleeve 27 is externally fit to the outer periphery of the sheath 15 at a position retracted from an end part of the shielded cable 11 by a predetermined length. As shown in FIG. 4, a part of the sheath 15 in front of a front end part of the sleeve 27 is stripped, thereby exposing the braided wire 14 from the sheath 15. The braided wire 14 is cut to a predetermined length to expose the coated wires 13 from the braided wire 14. The sleeve 27 serves as a mark of a position for the stripping of the sheath 15. As shown in FIG. 5, the braided wire 14 is folded rearward and overlapped on the sleeve 27. By stripping the insulation coatings 17 to a predetermined length on ends of the coated wires 13, the cores 16 are exposed from the insulation coatings 17.

Figure 8:
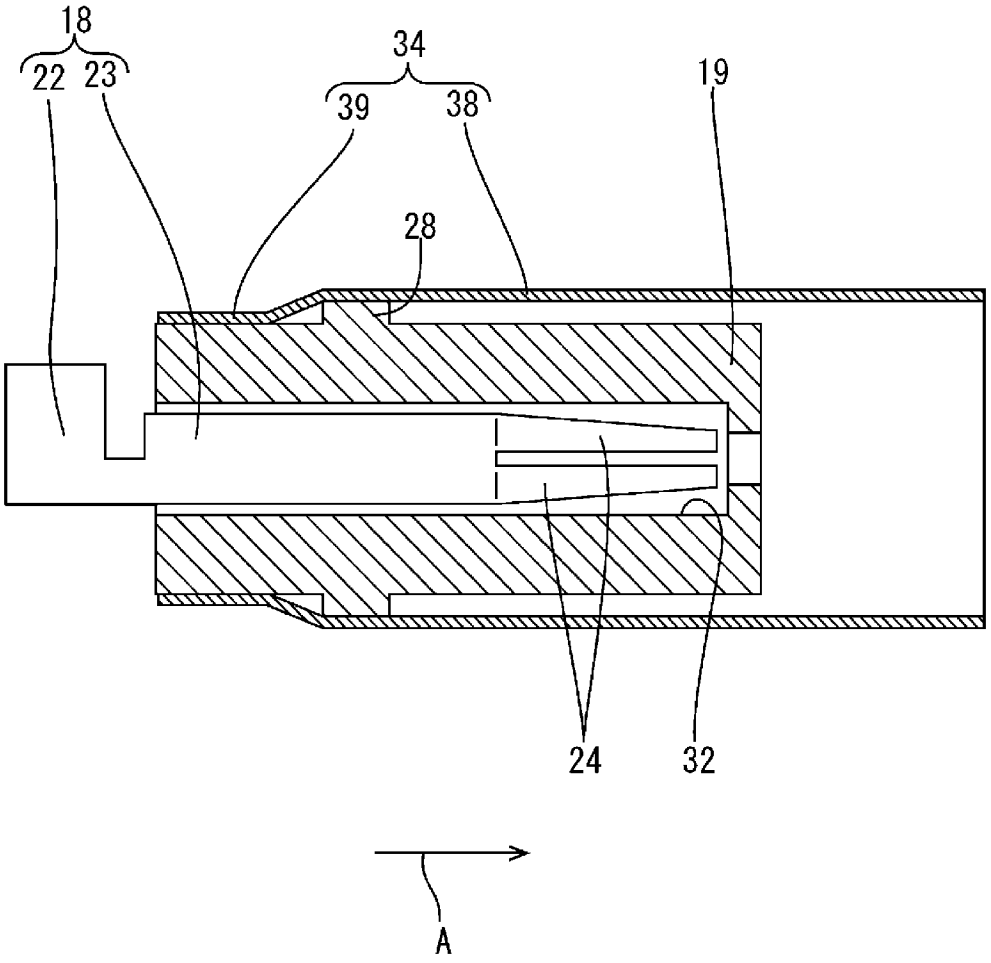
FIG. 8 is a section showing the state where the female terminals are inserted in the dielectric.

As shown in FIG. 6, the female terminals 18 are inserted into the cavities 32 of the dielectric 19 from behind. As shown in FIGS. 7 and 8, the wire barrel 22 of the female terminal 18 projects rearward from the rear end part of the dielectric 19.

The front outer conductor 34 is formed into a tubular shape. The dielectric 19 is inserted into the front tube portion 38 of the front outer conductor 34 from front. As shown in FIG. 8, the part of the dielectric 19 behind the flange 28 is locked to the dielectric locking portion 39 of the front outer conductor 34 from front. In this way, the dielectric 19 is held in the front outer conductor 34 while being prevented from coming out rearward.

As shown in FIG. 9, the female terminal 18 is connected to the end of the coated wire 13 by crimping the wire barrel 22 to the outer periphery of the core 16 exposed from the front end of the insulation coating 17.

Figure 10:
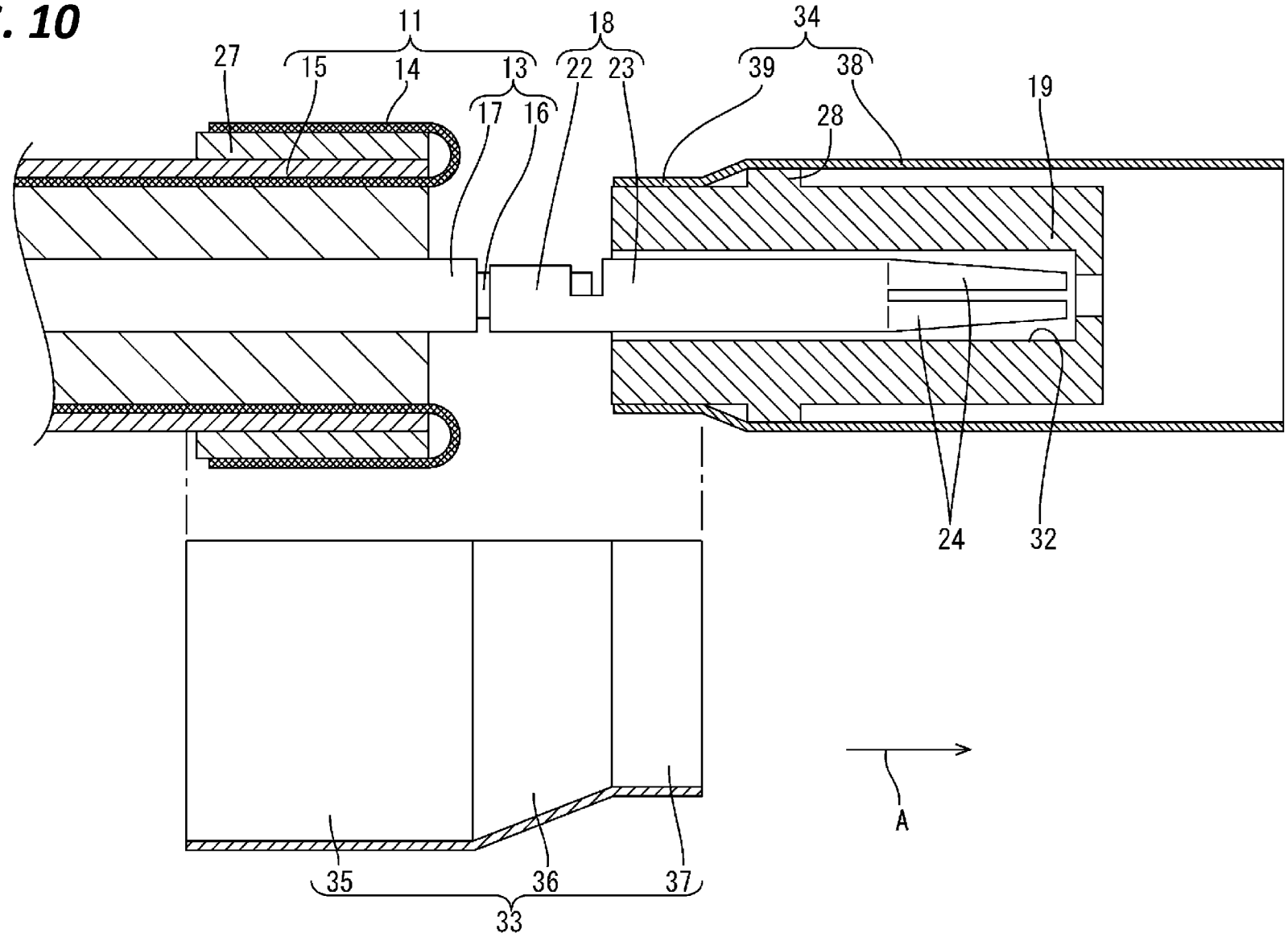
FIG. 10 is a section showing a step of crimping a rear outer conductor to the braided wire and a dielectric locking portion.

As shown in FIG. 10, the shield crimping portion 35 of the rear outer conductor 33 is crimped to the braided wire 14 folded on the sleeve 27 from outside. Further, the front outer conductor crimping portion 37 of the rear outer conductor 33 is crimped to the dielectric locking portion 39 of the front outer conductor 34 from outside.

A step of crimping the shield crimping portion 35 to the braided wire 14 and a step of crimping the front outer conductor crimping portion 37 to the dielectric locking portion 39 may be performed in the same step. Further, the step of crimping the shield crimping portion 35 to the braided wire 14 and the step of crimping the front outer conductor crimping portion 37 to the dielectric locking portion 39 may be separately performed. For example, the front outer conductor crimping portion 37 may be crimped to the dielectric locking portion 39 after the shield crimping portion 35 is first crimped to the braided wire 14 or the shield crimping portion 35 may be crimped to the braided wire 14 after the front outer conductor crimping portion 37 is first crimped to the dielectric locking portion 39. In the above way, the female connector structure 10 is completed (see FIGS. 1 and 2).

Functions and Effects of First Embodiment

Next, functions and effects of this embodiment are described. According to this embodiment, the female connector structure 10 is provided with the shielded cable 11 configured such that the outer peripheries of the coated wires 13 each including the core 16 extending in the front-rear direction and the insulation coating 17 surrounding the outer periphery of the core 16 are surrounded by the braided wire 14, the female terminals 18 each including the wire barrel 22 to be connected to the core 16 and the connecting tube portion 23 continuous with the wire barrel 22 and to be connected to the mating terminal, the insulating dielectric 19 for surrounding at least the outer peripheries of the connecting tube portions 23 of the female terminals 18, the front outer conductor 34 including the front tube portion 38 for surrounding the outer periphery of the dielectric 19 and the dielectric locking portion 39 to be locked to at least a part of the dielectric 19, and the rear outer conductor 33 including the rear tube portion 36 for surrounding the outer peripheries of the coated wires 13 exposed from the braided wire 14, the shield crimping portion 35 to be crimped to the braided wire 14 from outside and the front outer conductor crimping portion 37 to be crimped to the dielectric locking portion 39 from outside.

According to the above configuration, the front and rear outer conductors 34, 33 are connected by crimping the front outer conductor crimping portion 37 provided in the rear outer conductor 33 to the dielectric locking portion 39 provided in the front outer conductor 34 from outside. Since processing such as welding becomes unnecessary in this way, the rear and front outer conductors 33, 34 can be connected without heating. In this way, the occurrence of troubles in the dielectric 19 due to heat can be suppressed.

Further, a manufacturing method of the female connector structure 10 disclosed in this specification includes a step of the exposing the cores 16 by stripping the front end parts of the insulation coatings 17 of the shielded cable 11 configured such that the outer peripheries of the coated wires 13 each including the core 16 extending in the front-rear direction and the insulation coating 17 surrounding the outer periphery of the core 16 are surrounded by the braided wire 14, a step of arranging the female terminals 18 in the insulating dielectric 19 with the wire barrels 22 exposed, a step of accommodating the dielectric 19 inside the front outer conductor 34, a step of connecting the wire barrels 22 of the female terminals to the cores 16 exposed from the insulation coatings 17, a step of locking the dielectric locking portion 39 of the front outer conductor 34 to a part of the dielectric 19, a step of crimping the shield crimping portion 35 provided in the rear outer conductor 33 to the braided wire 14 from outside, and a step of crimping the front outer conductor crimping portion 37 provided in the rear outer conductor 33 to at least a part of the dielectric locking portion 39 from outside.

According to the above configuration, the rear and front outer conductors 33, 34 are connected by crimping the front outer conductor crimping portion 37 of the rear outer conductor 33 to at least a part of the dielectric 19 and locking the dielectric locking portion 39 to at least a part of the front outer conductor crimping portion 37. In this way, the rear and front outer conductors 33, 34 can be connected without welding. As a result, the rear and front outer conductors 33, 34 can be connected without being heated, wherefore the occurrence of troubles in the dielectric 19 due to heat can be suppressed.

Further, according to this embodiment, the dielectric locking portion 39 has a smaller diameter than the front tube portion 38 in a radial direction of the front tube portion 38 and the dielectric 19 includes the flange 28 configured to come into contact with the inner wall surface of the dielectric locking portion 39 from front. In this way, the dielectric 19 can be retained and held in the front outer conductor 34.

Second Embodiment

Figure 11:
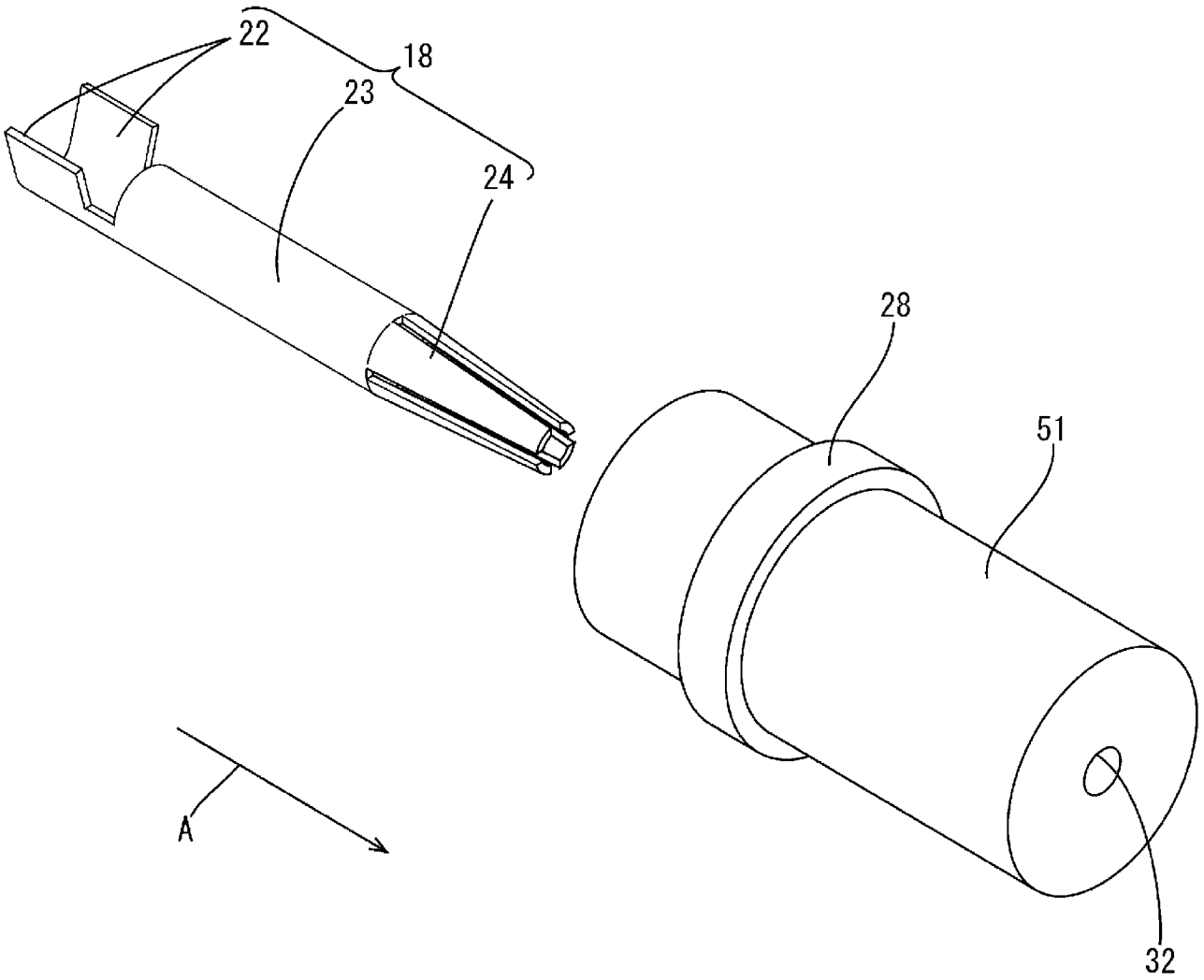
FIG. 11 is a perspective view showing a step of inserting a female terminal into a dielectric in a female connector structure according to a second embodiment.
Figure 12:
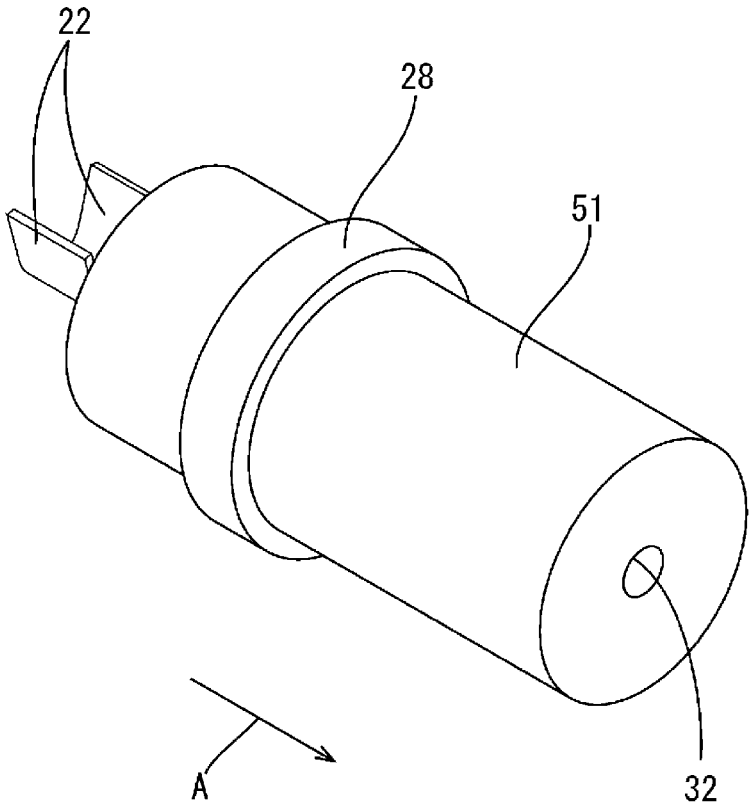
FIG. 12 is a perspective view showing a state where the female terminal is inserted in the dielectric.
Figure 13:
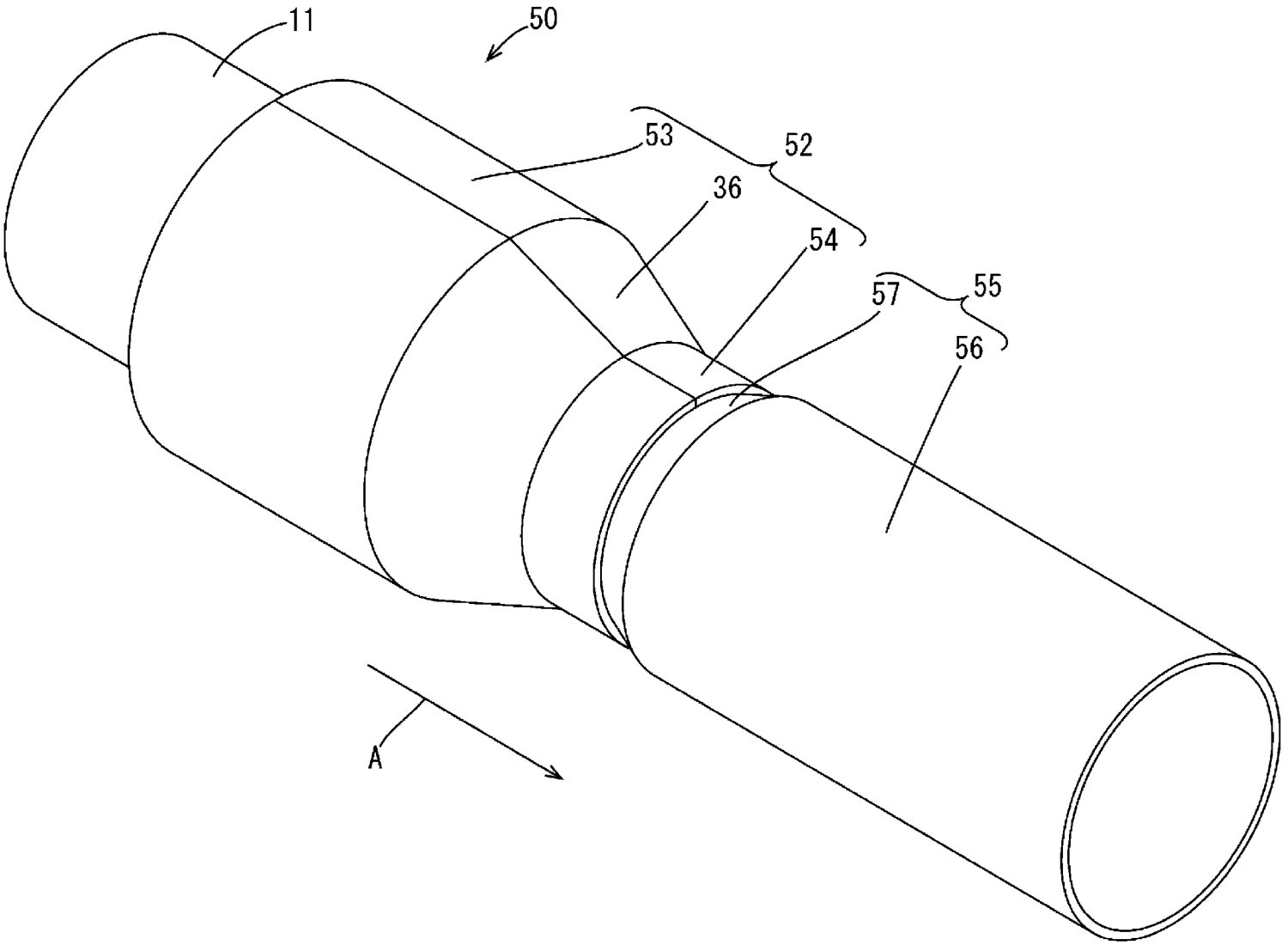
FIG. 13 is a perspective view showing the female connector structure according to the second embodiment.

Next, a second embodiment of the technique disclosed in this specification is described with reference to FIGS. 11 to 13. In a female connector structure 50 according to this embodiment, a dielectric 51 has a substantially hollow cylindrical shape extending in a front-rear direction. The dielectric 51 is formed with one cavity 32 open forward and rearward. One female terminal 18 is accommodated in the cavity 32.

A rear outer conductor 52 includes a shield crimping portion 53 having a substantially hollow cylindrical shape and a front outer conductor crimping portion 54 formed coaxially with the shield crimping portion 53 and having a substantially hollow cylindrical shape.

A front outer conductor 55 includes a front tube portion 56 having a substantially hollow cylindrical shape and a dielectric locking portion 57 formed coaxially with the front tube portion 56. The dielectric locking portion 57 has a smaller diameter than the front tube portion 56.

The dielectric 51 according to this embodiment can be effectively applied to the female connector structure 50 including a shielded cable 11 in which one coated wire 13 is disposed in a sheath 15.

Since the other configuration is substantially the same as in the first embodiment, the same members are denoted by the same reference signs and repeated description is omitted.

Third Embodiment

Figure 14:
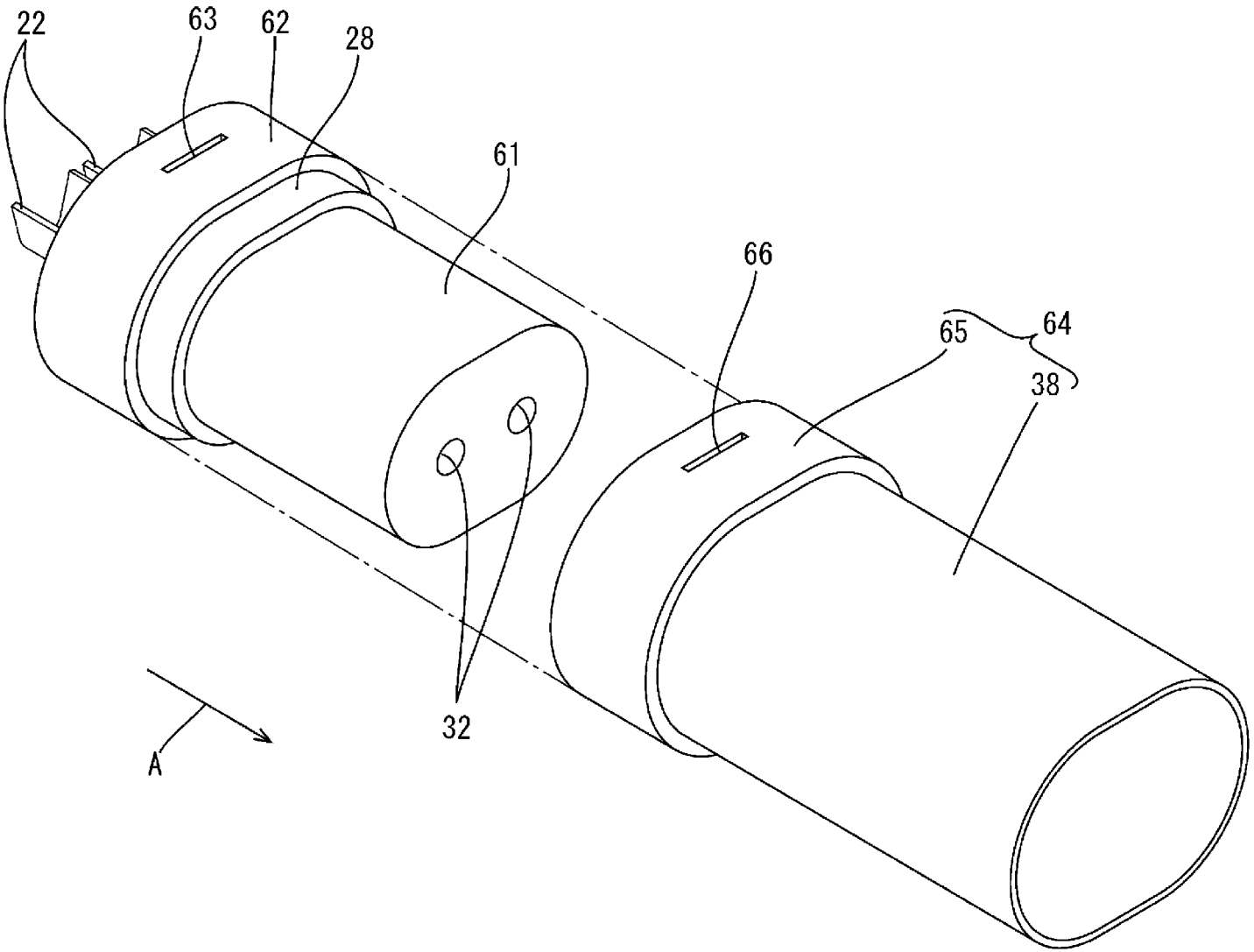
FIG. 14 is a perspective view showing a step of inserting a dielectric into a front outer conductor in a female connector structure according to a third embodiment.

Next, a third embodiment of the technique disclosed in this specification is described with reference to FIGS. 14 to 16. As shown in FIG. 14, a dielectric 61 according to this embodiment is formed with a retaining portion 62 located behind a flange 28 and having a larger diameter than the flange 28 in a radial direction of the dielectric 61. The upper and lower surfaces of the retaining portion 62 are formed with positioning recesses 63 in the form of grooves elongated in a lateral direction.

Figure 15:
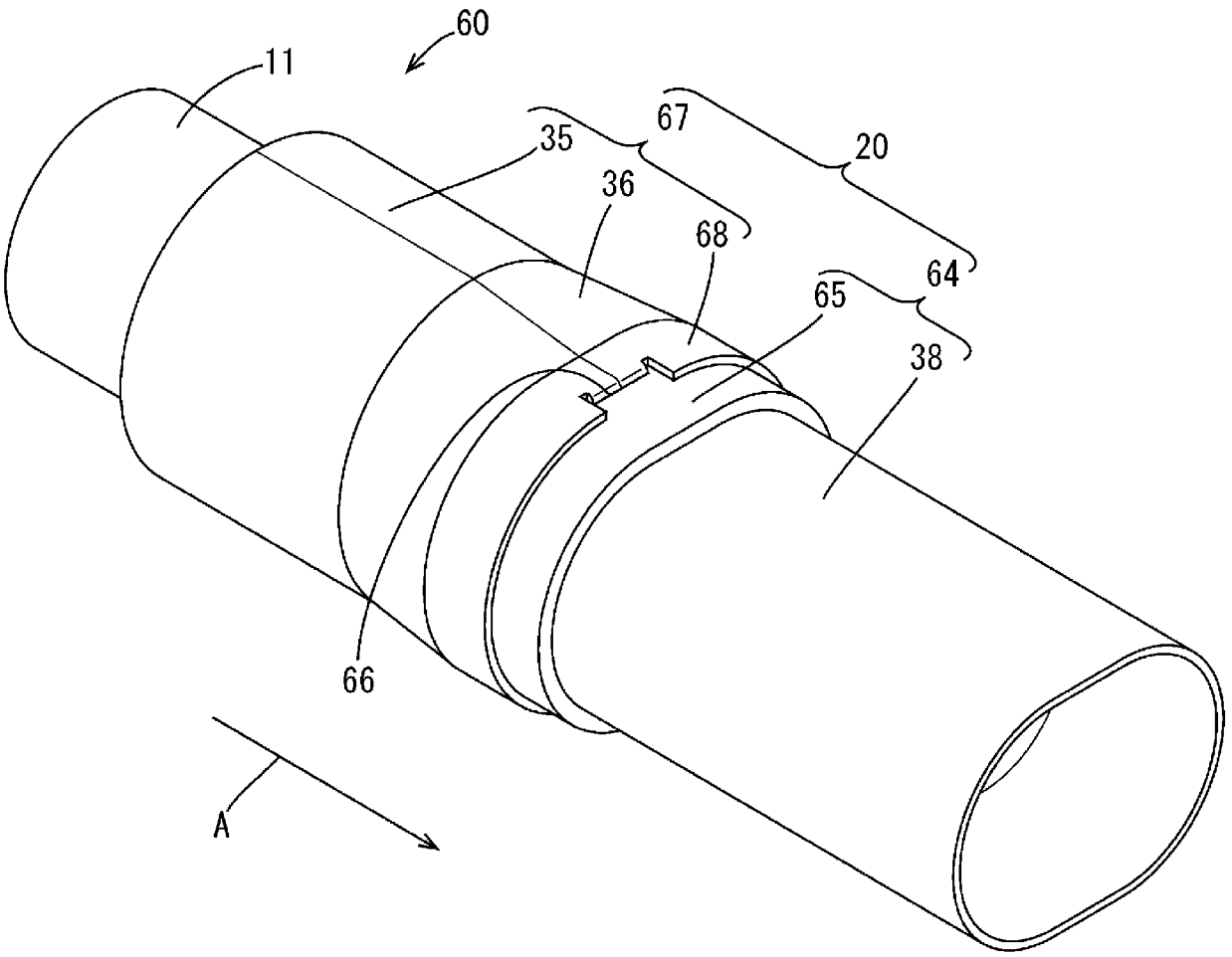
FIG. 15 is a perspective view showing the female connector structure according to the third embodiment.
Figure 16:
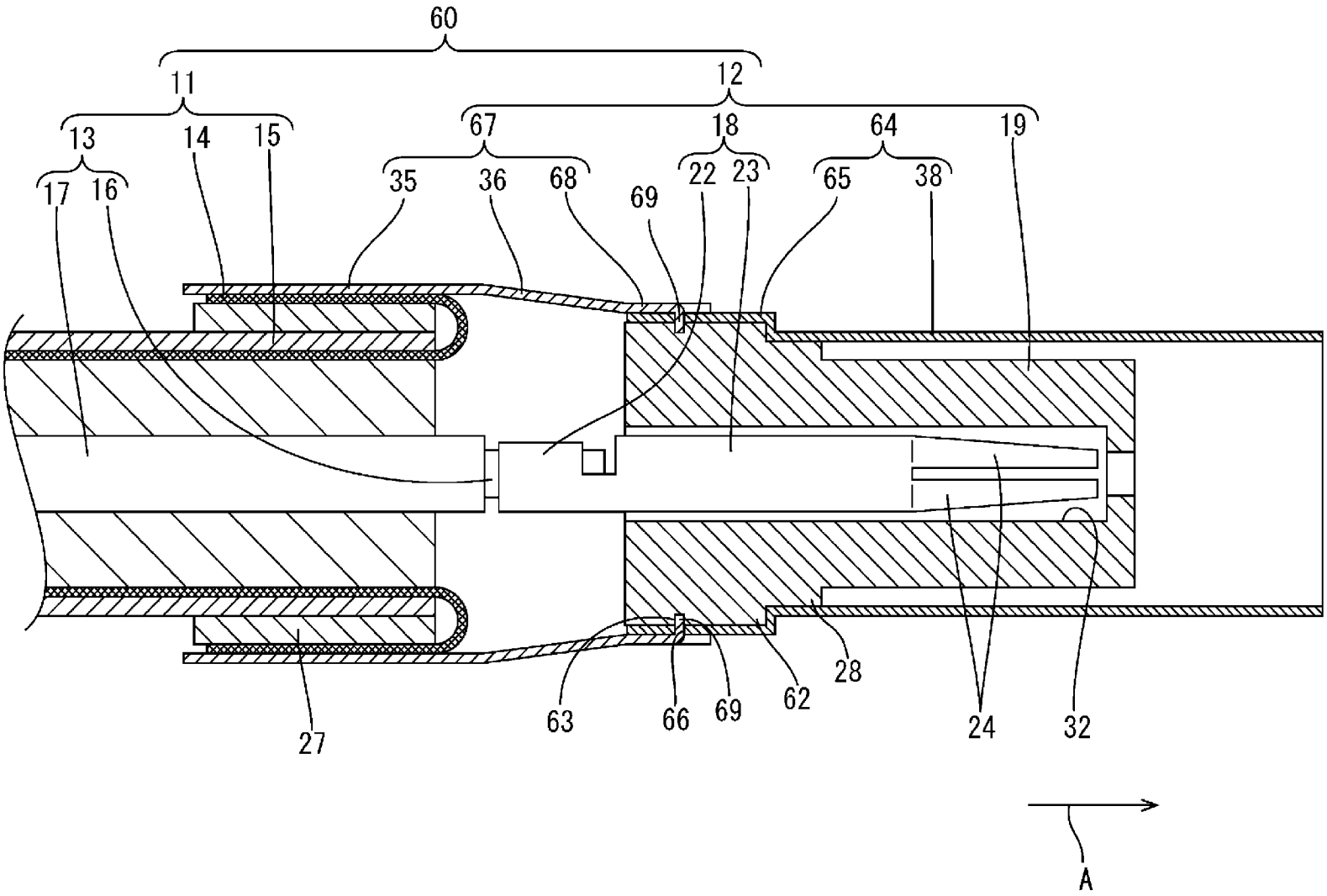
FIG. 16 is a section showing the female connector structure according to the third embodiment.

As shown in FIGS. 15 and 16, a dielectric locking portion 65 to be locked to the retaining portion 62 of the dielectric 61 from outside is formed at a position near a rear end part of a front outer conductor 64 according to this embodiment. The dielectric locking portion 65 has a larger diameter than a front tube portion 38. The inner shape of the dielectric locking portion 65 is substantially the same as the outer shape of the retaining portion 62 of the dielectric 61.

The dielectric 61 is inserted into the front outer conductor 64 from behind. The retaining portion 62 of the dielectric 61 is locked to the inner wall surface of the dielectric locking portion 65 of the front outer conductor 64 from behind. In this way, the dielectric 61 is held in the front outer conductor 64 while being prevented from coming out rearward.

The dielectric locking portion 65 formed in the front outer conductor 64 is formed with through holes 66 at positions corresponding to the positioning recesses 63 with the dielectric 61 disposed inside the front outer conductor 64. The through hole 66 has a shape elongated in the lateral direction and is formed to have substantially the same shape as an opening of the positioning recess 63. Substantially the same shape means not only the same shape, but also shapes, which are not the same shape, but can be certified to be substantially the same shape.

As shown in FIGS. 15 and 16, a rear outer conductor 67 according to this embodiment is formed with positioning projections 69 on a front outer conductor crimping portion 68. The positioning projections 69 are formed by bending the front end edge of the rear outer conductor 67 inwardly. The positioning projections 69 are formed to project radially inwardly of the dielectric 61 at positions corresponding to the through holes 66 and the positioning recesses 63 with the front outer conductor crimping portion 68 crimped to the dielectric locking portion 65 from outside. A projection dimension of the positioning projection 69 from the front outer conductor crimping portion 68 is set to be equal to or somewhat smaller than the sum of a thickness of the dielectric locking portion 65 and a depth of the positioning recess 63.

As shown in FIG. 16, the positioning projections 69 are passed through the dielectric locking portion 65 of the front outer conductor 64 and fit in the positioning recesses 63 of the dielectric 61 with the front outer conductor crimping portion 68 crimped to the dielectric locking portion 65 from outside. In this way, the positioning projections 69 are locked to the inner surfaces of the through holes 66 and the inner surfaces of the positioning recesses 63 in a front-rear direction and the lateral direction.

Since the other configuration is substantially the same as in the first embodiment, the same members are denoted by the same reference signs and repeated description is omitted.

In this embodiment, the dielectric locking portion 65 has a larger diameter than the front tube portion 38 and the dielectric 61 includes the retaining portion 62 configured to come into contact with the inner wall surface of the dielectric locking portion 65 from behind. In this way, the dielectric 61 can be held in the front outer conductor 64 while being prevented from coming out rearward.

Further, in this embodiment, the front outer conductor crimping portion 68 is formed with the positioning projections 69 projecting inward with the front outer conductor crimping portion 68 crimped to the outer periphery of the front outer conductor 64, and the positioning projections 69 are passed through the front outer conductor 64 and fit in the positioning recesses 63 formed by depressing the dielectric 61. In this way, the relative positional accuracy of the front outer conductor 64, the rear outer conductor 67 and the dielectric 61 can be improved.

Fourth Embodiment

Figure 17:
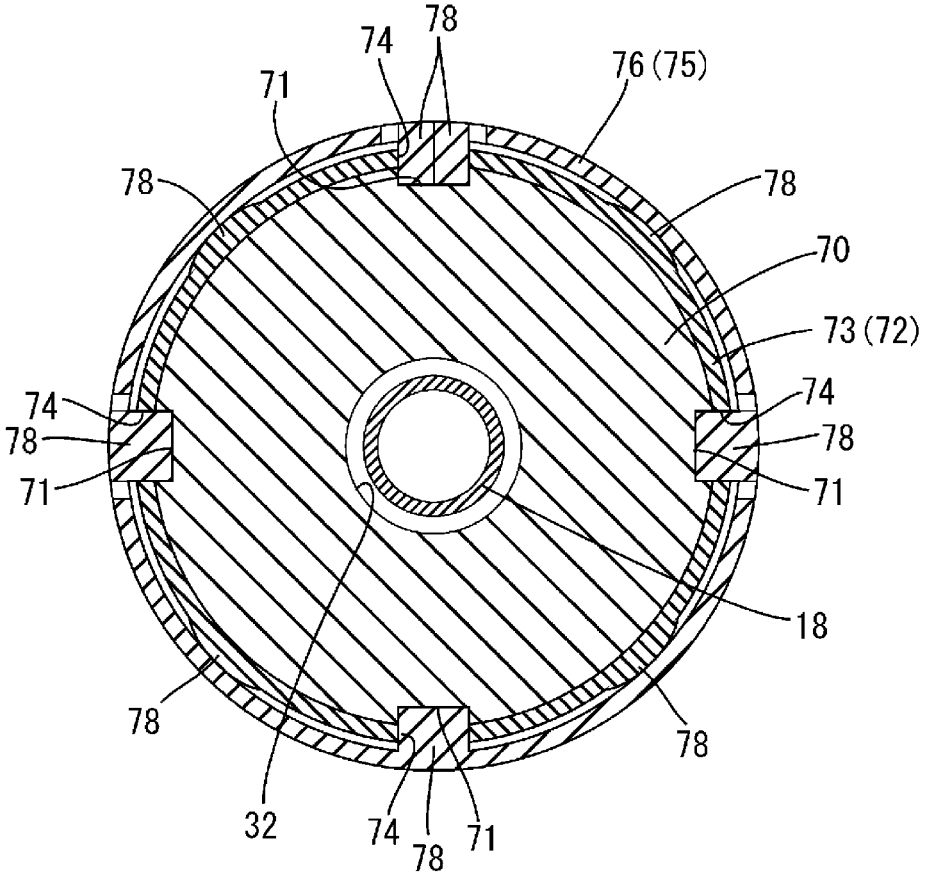
FIG. 17 is a section showing a fit state of positioning projections and positioning recesses in a female connector structure according to a fourth embodiment.

Next, a fourth embodiment of the technique disclosed in this specification is described with reference to FIG. 17. In this embodiment, a dielectric 70 includes one cavity 32. A female terminal 18 is accommodated in the cavity 32. The dielectric 70 has a hollow cylindrical shape extending in a front-rear direction. A plurality of (four in this embodiment) positioning recesses 71 are provided at intervals in a circumferential direction of the dielectric 70 on the outer surface of the dielectric 70. The four positioning recesses 71 are provided in upper, lower, left and right parts of the dielectric 70.

A dielectric locking portion 73 of a front outer conductor 72 is externally fit to the outer periphery of the dielectric 70. The dielectric locking portion 73 is formed with a plurality of (four in this embodiment) through holes 74 at positions corresponding to the positioning recesses 71 of the dielectric 70 with the dielectric locking portion 73 externally fit to the dielectric 70.

A front outer conductor crimping portion 76 of a rear outer conductor 75 is crimped to the dielectric locking portion 73 from outside. Positioning projections 77 projecting inward are formed at positions corresponding to the through holes 74 and the positioning recesses 71 with the front outer conductor crimping portion 76 crimped to the dielectric locking portion 73. The positioning projections 77 are formed by bending the front end edge of the rear outer conductor 75 inwardly. The positioning projections 77 are formed to project radially inwardly of the dielectric 70 at the positions corresponding to the through holes 74 and the positioning recesses 71 with the front outer conductor crimping portion 76 crimped to the dielectric locking portion 73 from outside.

A plurality of (four in this embodiment) connecting protrusions 78 projecting toward the front outer conductor crimping portion 76 are provided in parts of the dielectric locking portion 73 crimped by the front outer conductor crimping portion 76 with the front outer conductor crimping portion 76 crimped to the outer periphery of the front outer conductor 72. The four connecting protrusions 78 are provided at intervals in a circumferential direction of the dielectric locking portion 73 and at positions different from the through holes 74. The connecting protrusions 78 are in contact with the inner surface of the front outer conductor crimping portion 76 from inside with the front outer conductor crimping portion 76 crimped to the dielectric locking portion 73 of the front outer conductor 72. In this way, the rear and front outer conductors 75, 72 are reliably electrically connected. In this way, the electrical connection reliability of the rear and front outer conductors 75, 72 can be improved.

Since the other configuration is substantially the same as in the first embodiment, the same members are denoted by the same reference signs and repeated description is omitted.

Fifth Embodiment

Figure 18:
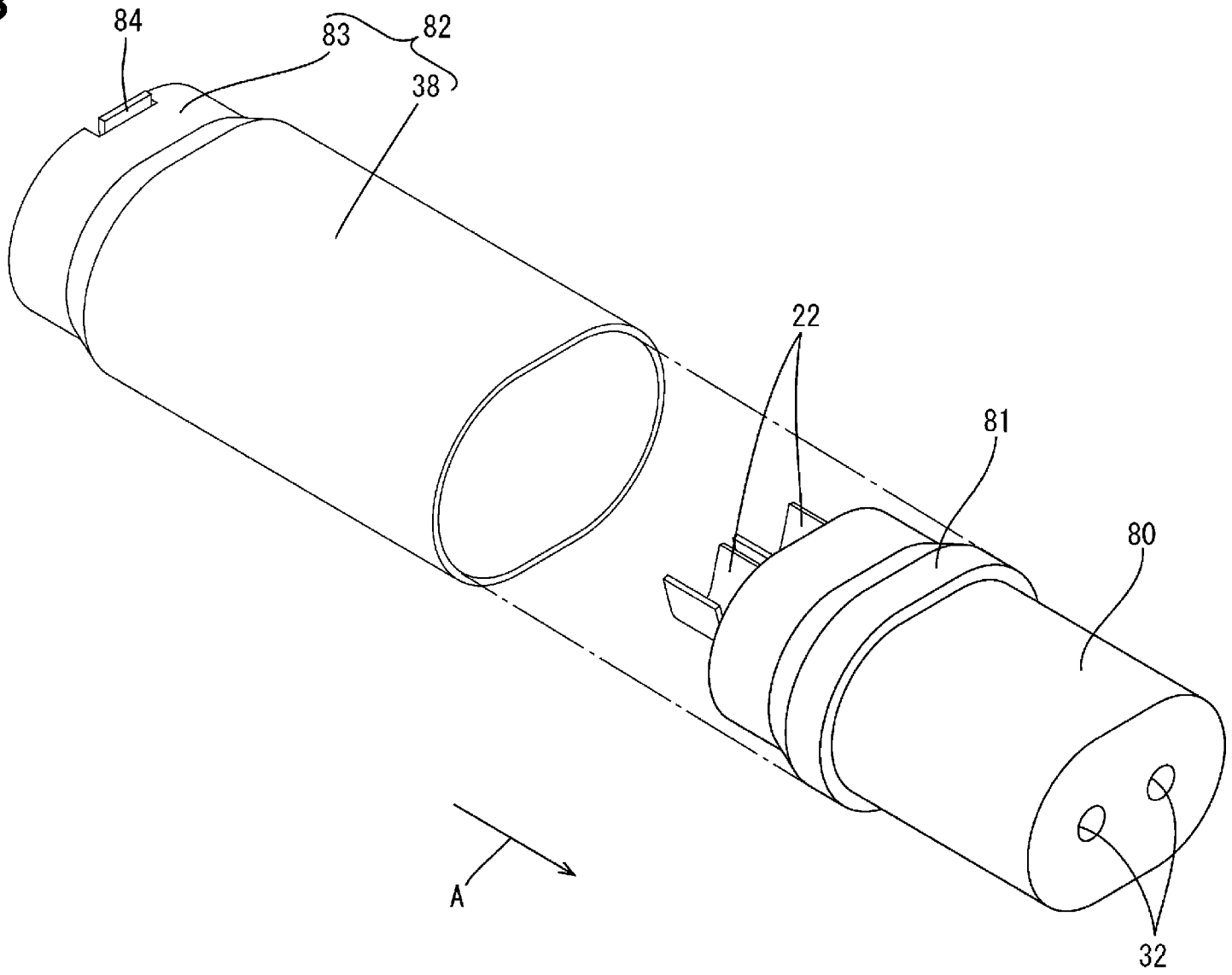
FIG. 18 is a perspective view showing a step of inserting a dielectric into a front outer conductor in a female connector structure according to a fifth embodiment.
Figure 19:
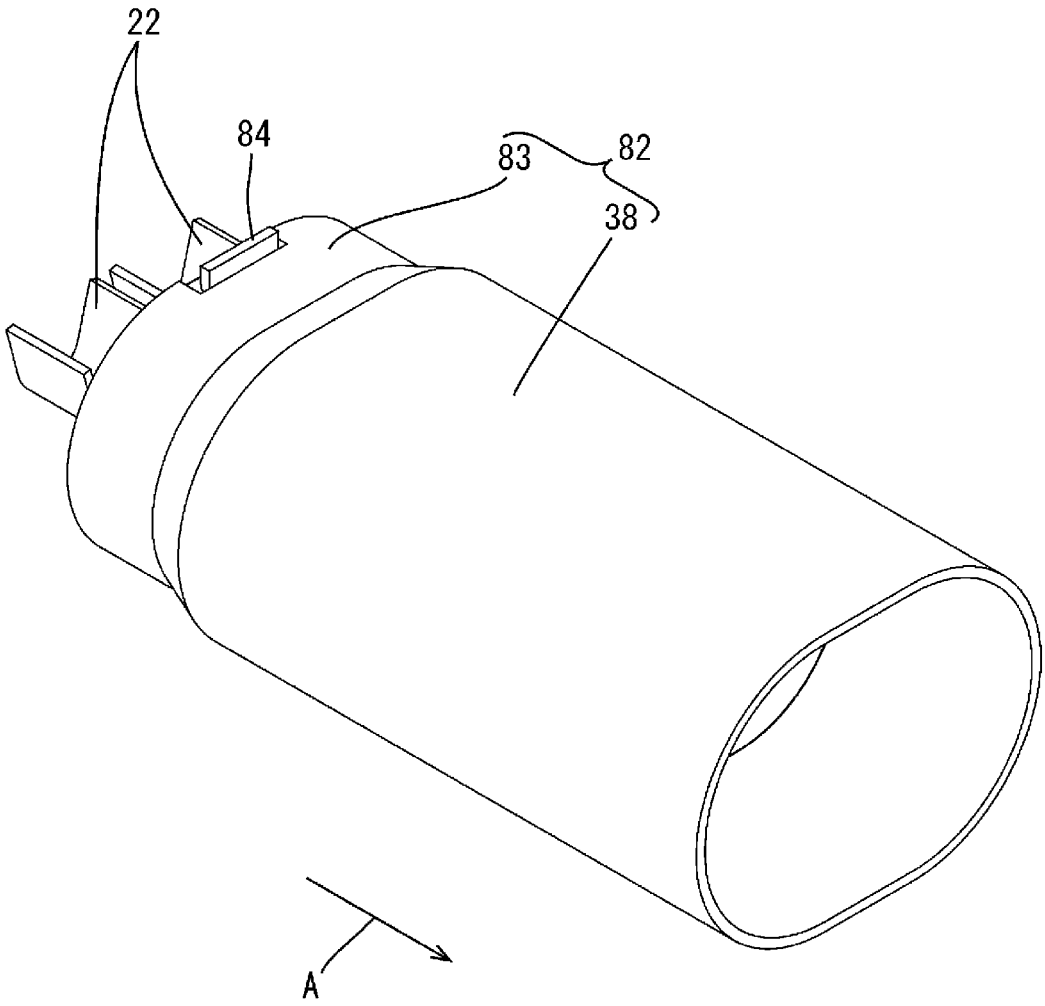
FIG. 19 is a perspective view showing a state where the dielectric is disposed in the front outer conductor.

Next, a fifth embodiment of the technique disclosed in this specification is described with reference to FIGS. 18 to 20. As shown in FIG. 18, a rear end part of a flange 81 is inclined to be reduced in diameter toward a rear side in a dielectric 80 according to this embodiment. The rear end part of the flange 81 is shaped to match the shape of a part of a front outer conductor 82 coupling a front tube portion 38 and a dielectric locking portion 83.

Figure 20:
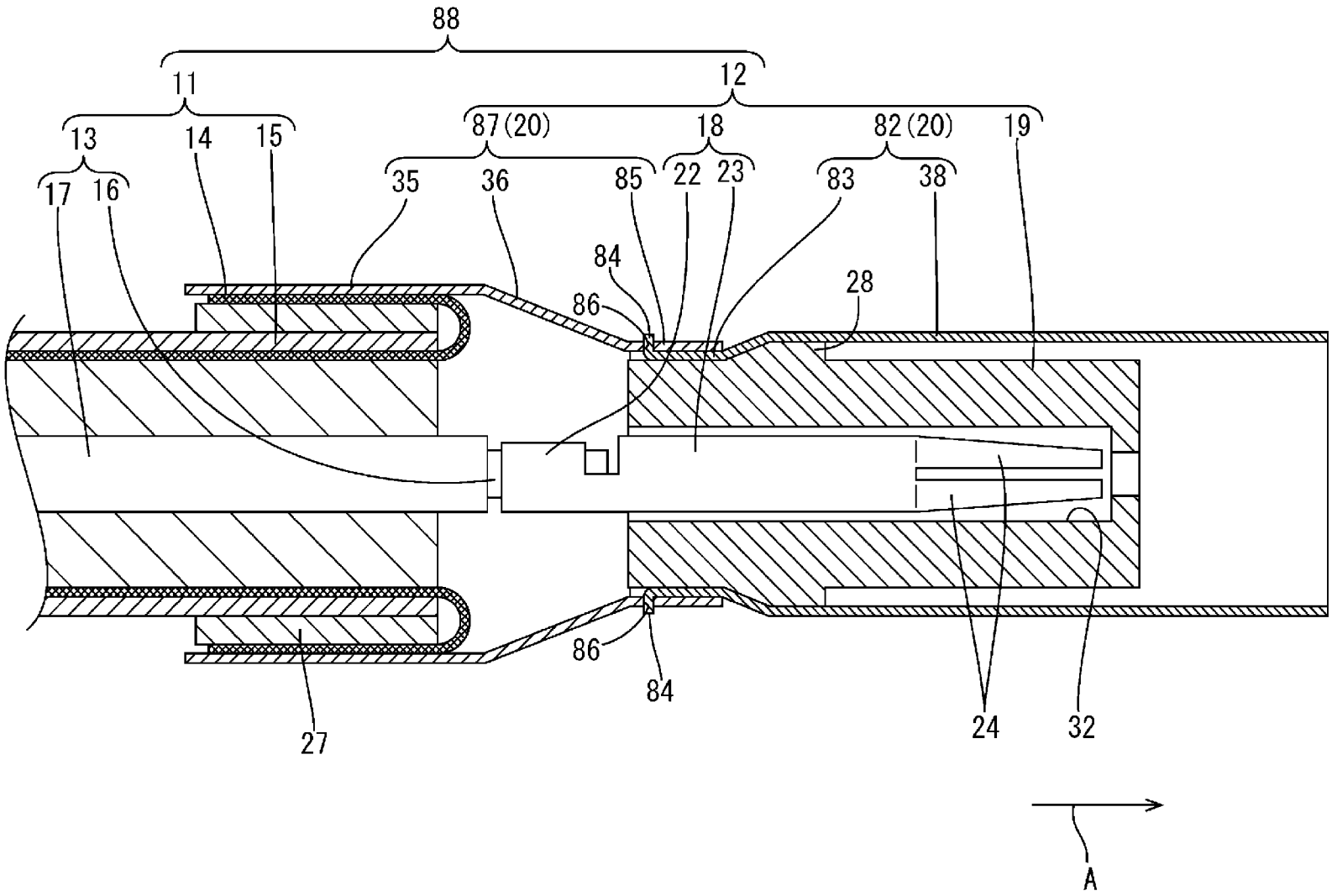
FIG. 20 is a section showing the female connector structure according to the fifth embodiment.

As shown in FIG. 20, a rear end part of the dielectric locking portion 83 according to this embodiment is cut and raised to form locking projections 84 projecting upward and downward. A projection height of the locking projection 84 from the dielectric locking portion 83 is set to be larger than a thickness of the front outer conductor crimping portion 85.

The front outer conductor crimping portion 85 is formed with locking recesses 86 penetrating through the front outer conductor crimping portion 85 at positions corresponding to the locking projections 84 with the front outer conductor crimping portion 85 crimped to the dielectric locking portion 83. The inner shape of the locking recess 86 is set to be the same as or somewhat larger than the outer shape of the locking projection 84. The locking projections 84 are fit in the locking recesses 86 with the front outer conductor crimping portion 85 crimped to the dielectric locking portion 83.

According to the above configuration, the locking projections 84 and the locking recesses 86 are locked to each other in a front-rear direction and a lateral direction, whereby the relative positional accuracy of the front and rear outer conductors 82, 87 can be improved.

Since the other configuration is substantially the same as in the first embodiment, the same members are denoted by the same reference signs and repeated description is omitted.

Sixth Embodiment

Next, a sixth embodiment of the technique disclosed in this specification is described with reference to FIGS. 21 and 22. As shown in FIG. 22, locking projections 90 projecting upward and downward are formed at positions near a rear end part of a dielectric locking portion 83 according to this embodiment by striking the dielectric locking portion 83 upward and downward. A projection dimension of the locking projection 90 from the dielectric locking portion 83 is set to be substantially equal to a thickness of a front outer conductor crimping portion 85.

Figure 21:
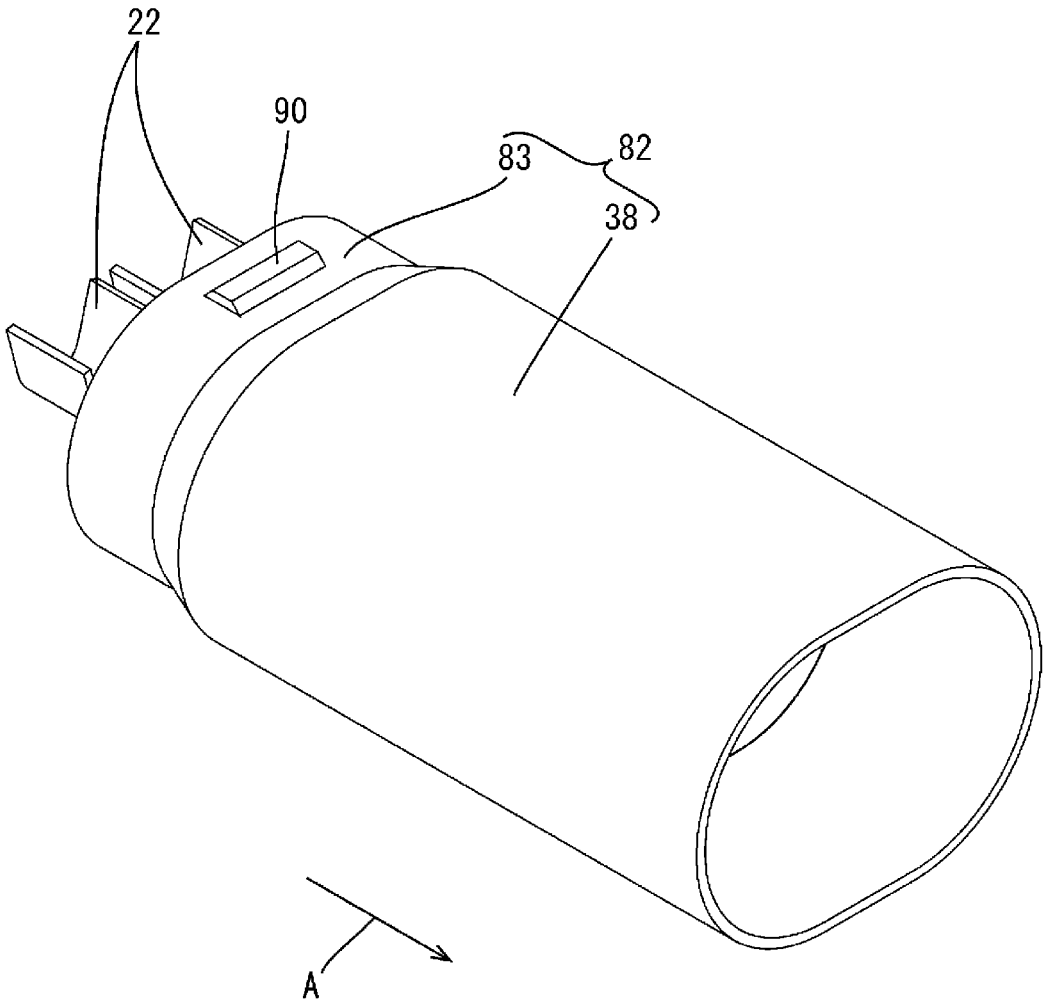
FIG. 21 is a perspective view showing a state where a dielectric is disposed in a front outer conductor in a female connector structure according to a sixth embodiment.
Figure 22:
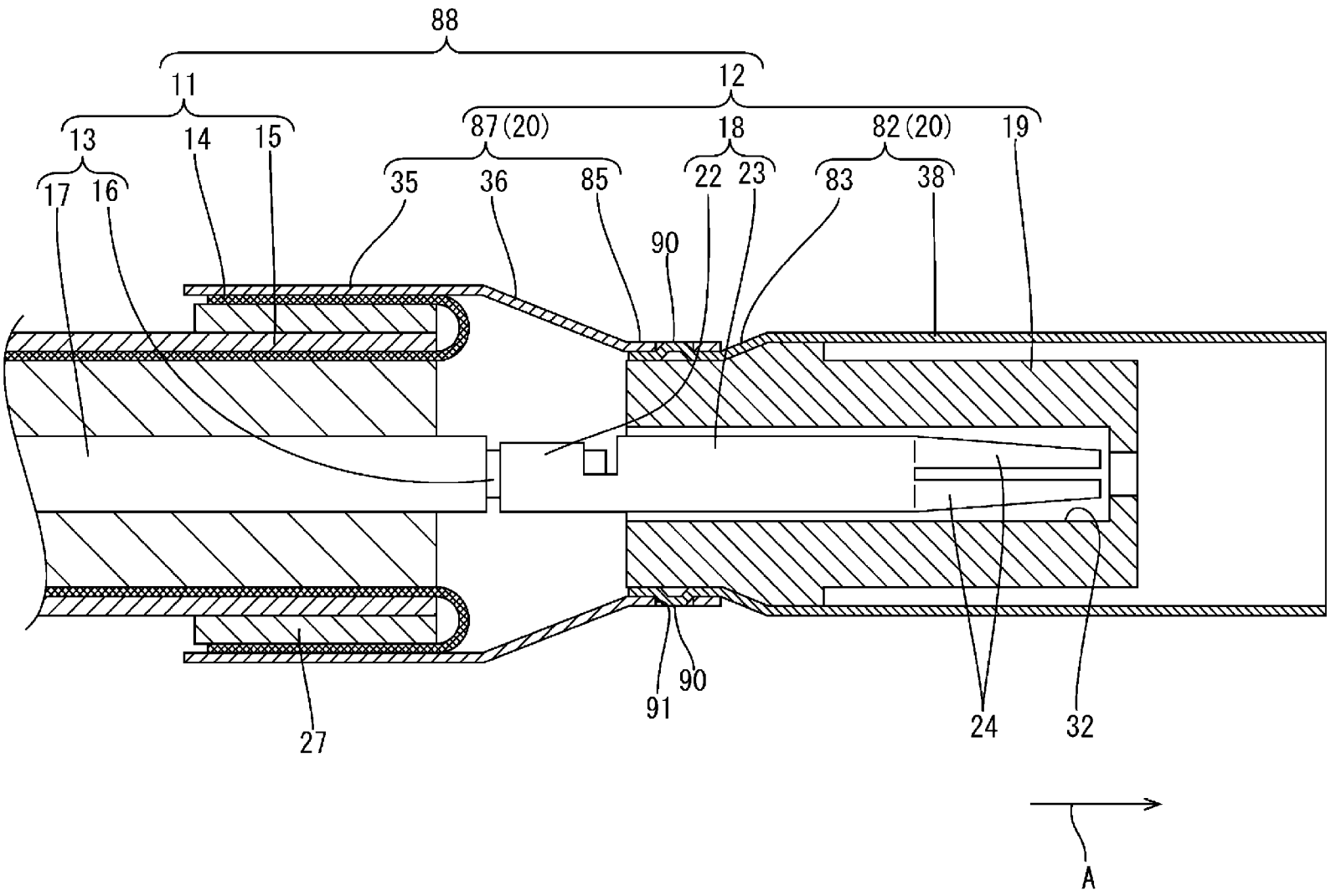
FIG. 22 is a section showing the female connector structure according to the sixth embodiment.

As shown in FIG. 21, the locking projection 90 is elongated in a lateral direction and formed to project outward in a radial direction of the dielectric locking portion 83.

The front outer conductor crimping portion 85 is formed with locking recesses 91 penetrating through the front outer conductor crimping portion 85 at positions corresponding to the locking projections 90 with the front outer conductor crimping portion 85 crimped to the dielectric locking portion 83. The inner shape of the locking recess 91 is set to be the same as or somewhat larger than the outer shape of the locking projection 90. With the front outer conductor crimping portion 85 crimped to the dielectric locking portion 83, the locking projections 90 are fit in the locking recesses 91.

According to the above configuration, the locking projections 90 and the locking recesses 91 are locked to each other in a front-rear direction and the lateral direction, whereby the relative positional accuracy of front and rear 82, 87 can be improved.

Since the other configuration is substantially the same as in the fifth embodiment, the same members are denoted by the same reference signs and repeated description is omitted.

Seventh Embodiment

Next, a seventh embodiment of the technique disclosed in this specification is described with reference to FIGS. 23 and 24. As shown in FIG. 24, locking projections 92 projecting upward and downward are formed at positions near a rear end part of a dielectric locking portion 83 according to this embodiment by folding a rear end part of the dielectric locking portion 83 forwardly. A projection height of the locking projection 92 from the dielectric locking portion 83 is set to be substantially equal to a thickness of a front outer conductor crimping portion 85.

Figure 23:
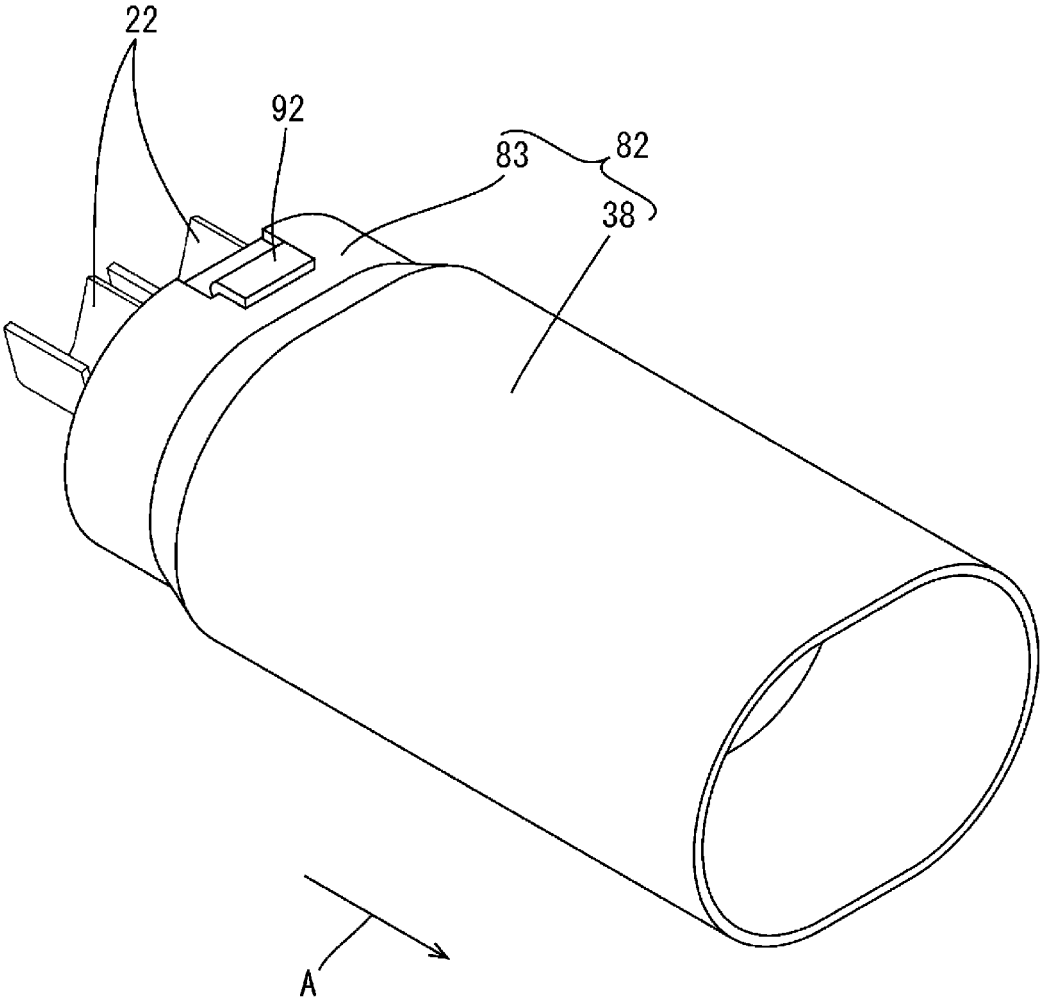
FIG. 23 is a perspective view showing a state where a dielectric is disposed in a front outer conductor in a female connector structure according to a seventh embodiment.
Figure 24:
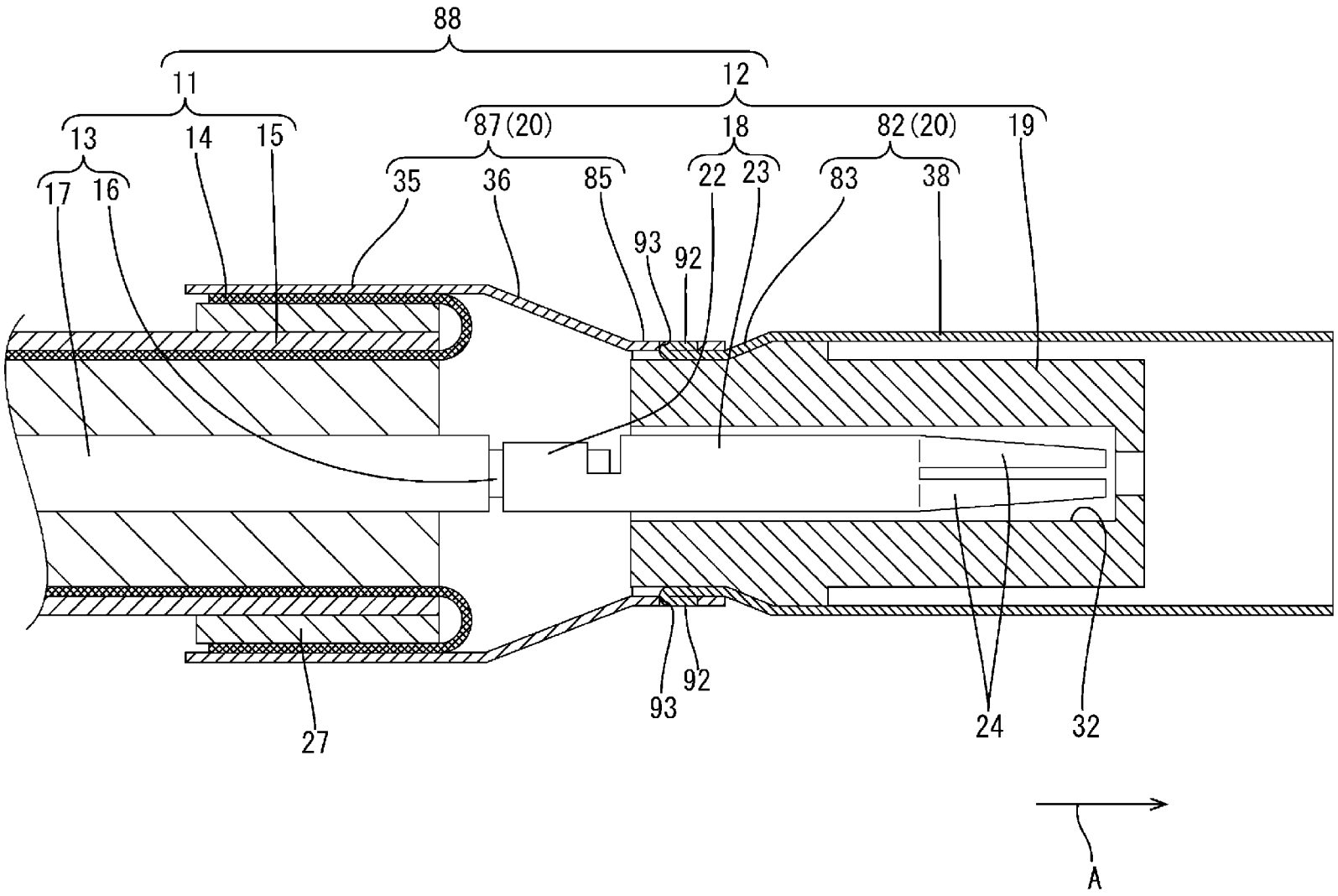
FIG. 24 is a section showing the female connector structure according to the seventh embodiment.

As shown in FIG. 23, the locking projection 92 is elongated in a lateral direction and formed to project outward in a radial direction of the dielectric locking portion 83.

The front outer conductor crimping portion 85 is formed with locking recesses 93 penetrating through the front outer conductor crimping portion 85 at positions corresponding to the locking projections 92 with the front outer conductor crimping portion 85 crimped to the dielectric locking portion 83. The inner shape of the locking recess 93 is set to be the same as or somewhat larger than the outer shape of the locking projection 92. With the front outer conductor crimping portion 85 crimped to the dielectric locking portion 83, the locking projections 92 are fit in the locking recesses 93.

According to the above configuration, the locking projections 92 and the locking recesses 93 are locked to each other in a front-rear direction and the lateral direction, whereby the relative positional accuracy of front and rear 82, 87 can be improved.

Since the other configuration is substantially the same as in the fifth embodiment, the same members are denoted by the same reference signs and repeated description is omitted.

Other Embodiments

The technique disclosed in this specification is not limited to the above described and illustrated embodiments. For example, the following embodiments are also included in the technical scope of the technique disclosed in this specification.

(1) The shielded cable may include three or more coated wires.

(2) An arbitrary material such as a metal foil or a resin tape having a metal foil adhered thereto can be appropriately selected for a shield layer without being limited to the braided wire 14.

(3) The sheath 15 may be omitted.

(4) The braided wire 14 exposed by stripping the sheath 15 may not be folded on the end of the sheath 15.

(5) The braided wire 14 and the shield crimping portion 35 may be electrically connected by crimping a crimping member formed separately from the rear outer conductor 33 to the shield crimping portion from outside the shield crimping portion with the shield crimping portion 35 externally fit to the outer periphery of the braided wire 14.

(6) The connector structure may be a male connector structure including male terminal(s).

(7) Connecting protrusions projecting toward the dielectric locking portion may be provided on the inner surface of the front outer conductor crimping portion.

(8) In the fifth to seventh embodiments, the front outer conductor crimping portion may be provided with locking projections projecting inward and the dielectric locking portion may be provided with locking recesses into which the locking projections are fit. Further, one, three or more locking recesses and one, three or more locking projections may be provided.

LIST OF REFERENCE NUMERALS

10, 50, 60: female connector structure (example of connector structure)
11: shielded cable
12: female connector
13: coated wire
14: braided wire (example of shield portion)
15: sheath
16: core
17: insulation coating
18: female terminal (example of inner conductor)
19, 51, 61, 70, 80: dielectric
20: outer conductor
22: wire barrel (example of core connecting portion)
23: connecting tube portion (example of connecting portion)
24: resilient contact piece
27: sleeve
28, 81: flange (example of retaining portion)
32: cavity
33, 52, 67, 75, 87: rear outer conductor
34, 55, 64, 72, 82: front outer conductor
35, 53: shield crimping portion
36: rear tube portion
37, 54, 68, 76, 85: front outer conductor crimping portion
38, 56: front tube portion
39, 57, 65, 73, 83: dielectric locking portion
62: retaining portion
63: positioning recess
66: through hole
69: positioning projection
71: positioning recess
74: through hole
77: positioning projection
78: connecting protrusion
84, 90, 92: locking projection
86, 91, 93: locking recess
88: female connector structure

What is claimed is:

1. A connector structure, comprising:

a shielded cable configured such that an outer periphery of a coated wire including a core extending in a front-rear direction and an insulation coating surrounding an outer periphery of the core is surrounded by a shield portion, a part of the shield portion exposed from an end of a sheath being folded and overlapped on an outside of an annular sleeve externally fit to an outside of the sheath;

an inner conductor including a core connecting portion to be connected to the core and a connecting portion continuous with the core connecting portion and to be connected to a mating terminal;

an insulating dielectric for surrounding at least an outer periphery of the connecting portion of the inner conductor;

a front outer conductor including a front tube portion for surrounding an outer periphery of the dielectric and a dielectric locking portion to be locked to at least a part of the dielectric; and a rear outer conductor including a rear tube portion for surrounding the outer periphery of the coated wire exposed from the shield portion, a shield crimping portion to be crimped to the part of the shield portion overlapped on the outside of the annular sleeve from outside and a front outer conductor crimping portion to be crimped to at least a part of the front outer conductor from outside.

2. The connection structure of claim 1, wherein:

the dielectric locking portion has a smaller or larger diameter than the front tube portion in a radial direction of the front tube portion, and the dielectric includes a retaining portion configured to come into contact with an inner wall surface of the dielectric locking portion from front or behind.

3. The connection structure of claim 1, wherein one of the front and rear outer conductors is provided with a locking projection projecting toward the other and the other is formed with a locking recess to be locked to the locking projection.

4. The connection structure of claim 1, wherein:

the front outer conductor crimping portion is formed with a positioning projection projecting inward with the front outer conductor crimping portion crimped to an outer periphery of the front outer conductor, and the positioning projection is passed through the front outer conductor and fit in a positioning recess formed by depressing the dielectric.

5. The connection structure of claim 1, wherein one of the front outer conductor crimping portion and a part of the front outer conductor crimped by the front outer conductor crimping portion is provided with a connecting protrusion projecting toward the other with the front outer conductor crimping portion crimped to an outer periphery of the front outer conductor.

6. A connector structure manufacturing method, comprising:

exposing a core by stripping a front end part of an insulation coating of a shielded cable configured such that an outer periphery of a coated wire including the core extending in a front-rear direction and the insulation coating surrounding an outer periphery of the core is surrounded by a shield portion;

folding a part of the shield portion exposed from an end of a sheath to be overlapped on an outside of an annular sleeve externally fit to an outside of the sheath;

arranging an inner conductor in an insulating dielectric with a core connecting portion exposed;

accommodating the dielectric inside a front outer conductor;

connecting the core connecting portion of the inner conductor to the core exposed from the insulation coating;

locking a dielectric locking portion of the front outer conductor to a part of the dielectric;

crimping a shield crimping portion provided in a rear outer conductor to the part of the shield portion overlapped on the outside of the annular sleeve from outside; and crimping a front outer conductor crimping portion provided in the rear outer conductor to at least a part of the dielectric locking portion from outside.

* * * * *